US009114327B2

(12) United States Patent
Moh et al.

(10) Patent No.: US 9,114,327 B2
(45) Date of Patent: Aug. 25, 2015

(54) TOY PLAYSET

(75) Inventors: Richelle Moh, Redondo Beach, CA (US); Garrett Sander, Los Angeles, CA (US); Ivy Bleser, Santa Monica, CA (US); David Sheltman, Rancho Palos Verdes, CA (US); Sang Kwak, La Habra, CA (US); Elena Velasquez, Los Angeles, CA (US)

(73) Assignee: MATTEL, INC., El Segundo, CA (US)

( * ) Notice: Subject to any disclaimer, the term of this patent is extended or adjusted under 35 U.S.C. 154(b) by 546 days.

(21) Appl. No.: 13/270,178

(22) Filed: Oct. 10, 2011

(65) Prior Publication Data

US 2012/0115393 A1 May 10, 2012

Related U.S. Application Data

(60) Provisional application No. 61/391,336, filed on Oct. 8, 2010.

(51) Int. Cl.

| | |
|---|---|
| ***A63H 29/00*** | (2006.01) |
| ***A63H 33/26*** | (2006.01) |
| ***A63H 7/00*** | (2006.01) |
| ***A63H 17/00*** | (2006.01) |
| ***A63H 18/02*** | (2006.01) |
| ***A63H 33/42*** | (2006.01) |

(52) U.S. Cl.

CPC ..... *A63H 33/26* (2013.01); *A63H 7/00* (2013.01); *A63H 17/00* (2013.01); *A63H 18/028* (2013.01); *A63H 33/42* (2013.01)

(58) Field of Classification Search

USPC ..... 446/168–174, 429, 435

See application file for complete search history.

(56) References Cited

U.S. PATENT DOCUMENTS

| | | | | |
|---|---|---|---|---|
| 749,607 | A | | 1/1904 | Dutrieu |
| 1,323,232 | A | | 11/1919 | Page |
| 1,431,398 | A | | 10/1922 | Hetzner |
| 1,544,555 | A | | 7/1925 | Chase |
| 1,603,180 | A | | 10/1926 | Zabel |
| 1,695,310 | A | | 12/1928 | Wustendorfer |
| 2,443,689 | A | * | 6/1948 | Meehan ..... 446/364 |
| 3,379,440 | A | * | 4/1968 | Roy ..... 463/69 |
| 3,542,366 | A | | 11/1970 | Schocker |
| 3,574,969 | A | | 4/1971 | Torrance et al. |
| 3,621,602 | A | | 11/1971 | Barcus et al. |
| 3,658,333 | A | | 4/1972 | Carcel |
| 3,690,393 | A | | 9/1972 | Guy |
| 3,762,095 | A | * | 10/1973 | Merino et al. ..... 446/430 |
| 3,775,897 | A | * | 12/1973 | Soulakis et al. ..... 446/487 |
| 3,843,123 | A | | 10/1974 | Masuda |

(Continued)

FOREIGN PATENT DOCUMENTS

| | | | |
|---|---|---|---|
| WO | 2007056482 | A2 | 5/2007 |
| WO | 2007131196 | A2 | 11/2007 |

*Primary Examiner* — Melba Bumgarner
*Assistant Examiner* — Joseph B Baldori
(74) *Attorney, Agent, or Firm* — Cantor Colburn LLP

(57) ABSTRACT

A play set configured for use with an item removably secured to a base item having a plurality of wheels and a ferromagnetic material disposed therein is disclosed herein, the play set having: a plurality of launchers each being configured to launch the item and the base item along one of a plurality of track segments, wherein each of the track segments terminate at a central area; and at least one magnet disposed in the central area, wherein the base item is attracted to the at least one magnet when it reaches the central area after traversing along one of the plurality of track segments.

16 Claims, 37 Drawing Sheets

(56) References Cited

U.S. PATENT DOCUMENTS

| | | | | | |
|---|---|---|---|---|---|
| 3,926,435 | A * | 12/1975 | Nacci | 463/69 |
| 3,936,053 | A | 2/1976 | Goldfarb et al. | |
| 4,012,040 | A | 3/1977 | Fernandes | |
| 4,094,089 | A | 6/1978 | Sano | |
| 4,108,437 | A * | 8/1978 | DeAnda et al. | 463/59 |
| 4,146,991 | A * | 4/1979 | Sano | 446/430 |
| 4,208,834 | A * | 6/1980 | Lin | 446/226 |
| 4,261,133 | A * | 4/1981 | Hanson et al. | 446/397 |
| 4,349,983 | A | 9/1982 | Kilroy et al. | |
| 4,355,482 | A | 10/1982 | Sapkus et al. | |
| 4,383,688 | A | 5/1983 | Prehodka | |
| 4,403,440 | A | 9/1983 | Wulff | |
| 4,513,967 | A * | 4/1985 | Halford et al. | 273/108 |
| 4,519,789 | A | 5/1985 | Halford et al. | |
| 4,564,197 | A * | 1/1986 | Lambert et al. | 463/64 |
| 4,605,229 | A * | 8/1986 | McKay | 463/59 |
| 4,605,230 | A * | 8/1986 | Halford et al. | 273/129 AP |
| 4,834,371 | A | 5/1989 | Hay et al. | |
| 4,836,819 | A * | 6/1989 | Oishi et al. | 446/288 |
| 4,846,752 | A | 7/1989 | Combs | |
| 4,959,035 | A | 9/1990 | Murasaki | |
| 5,174,569 | A | 12/1992 | Ngai | |
| 5,254,030 | A * | 10/1993 | Ostendorff et al. | 446/430 |
| 5,643,040 | A | 7/1997 | Hippely et al. | |
| 5,893,791 | A | 4/1999 | Wilkinson | |
| 5,899,789 | A * | 5/1999 | Rehkemper et al. | 446/444 |
| 5,947,788 | A | 9/1999 | Derrah | |
| 5,971,832 | A | 10/1999 | Siboni | |
| 6,000,992 | A | 12/1999 | Lambert | |
| 6,074,271 | A * | 6/2000 | Derrah | 446/457 |
| 6,179,685 | B1 * | 1/2001 | Toft | 446/390 |
| 6,315,630 | B1 | 11/2001 | Yamasaki | |
| 6,332,616 | B1 | 12/2001 | Brown | |
| 6,350,174 | B1 | 2/2002 | Halford et al. | |
| 6,358,112 | B1 | 3/2002 | Lambert et al. | |
| 6,402,583 | B2 * | 6/2002 | Yoneda et al. | 446/423 |
| 6,406,350 | B2 * | 6/2002 | Yoneda et al. | 446/423 |
| 6,431,940 | B1 | 8/2002 | Buford et al. | |
| 6,435,929 | B1 | 8/2002 | Halford | |
| 6,457,710 | B1 | 10/2002 | Bisbee et al. | |
| 6,517,408 | B1 | 2/2003 | Rehkemper et al. | |
| 6,533,638 | B1 * | 3/2003 | Nelson et al. | 446/279 |
| 6,540,577 | B1 * | 4/2003 | Nelson et al. | 446/129 |
| 6,561,511 | B1 | 5/2003 | Vaysberg et al. | |
| 6,634,953 | B1 | 10/2003 | Czintos | |
| 6,676,476 | B1 * | 1/2004 | Lund et al. | 446/234 |
| 6,682,394 | B2 | 1/2004 | Tilbor et al. | |
| 6,726,523 | B2 * | 4/2004 | Baker et al. | 446/225 |
| 6,824,441 | B1 | 11/2004 | Wiggs et al. | |
| 6,893,318 | B2 | 5/2005 | Soviknes et al. | |
| 6,913,508 | B2 | 7/2005 | Hornsby et al. | |
| 6,971,942 | B2 * | 12/2005 | Baker et al. | 446/275 |
| 7,241,223 | B1 * | 7/2007 | Caudill | 463/62 |
| 7,244,164 | B2 * | 7/2007 | Isenberg | 446/132 |
| 7,261,613 | B1 * | 8/2007 | Hull | 446/444 |
| 7,297,042 | B2 * | 11/2007 | Whitehead | 446/139 |
| 7,338,342 | B2 | 3/2008 | Bellon | |
| 7,537,509 | B2 | 5/2009 | Payne et al. | |
| 7,578,719 | B1 | 8/2009 | Faanes et al. | |
| 7,601,068 | B1 * | 10/2009 | McGee | 463/58 |
| 7,618,302 | B2 | 11/2009 | Collins et al. | |
| 7,682,218 | B2 | 3/2010 | Yu et al. | |
| 7,686,671 | B2 | 3/2010 | Gotou et al. | |
| 7,690,964 | B2 | 4/2010 | Nuttall et al. | |
| 7,740,518 | B2 | 6/2010 | Elliott | |
| 7,753,753 | B2 | 7/2010 | Payne et al. | |
| 7,766,720 | B2 | 8/2010 | Ostendorff | |
| 7,794,301 | B2 | 9/2010 | Ostendorff et al. | |
| 7,901,266 | B2 * | 3/2011 | Ostendorff | 446/429 |
| 7,914,361 | B1 * | 3/2011 | Morris et al. | 446/444 |
| 7,934,970 | B2 * | 5/2011 | O'Connor | 446/6 |
| 8,298,035 | B2 * | 10/2012 | O'Connor | 446/6 |
| 8,298,038 | B2 * | 10/2012 | O'Connor et al. | 446/444 |
| 8,323,069 | B2 * | 12/2012 | Nuttall et al. | 446/444 |
| 8,430,712 | B2 * | 4/2013 | O'Connor et al. | 446/444 |
| 2001/0012745 | A1 * | 8/2001 | Yoneda et al. | 446/423 |
| 2004/0116041 | A1 * | 6/2004 | Isenberg | 446/331 |
| 2005/0112988 | A1 * | 5/2005 | Whitehead | 446/137 |
| 2006/0099876 | A1 * | 5/2006 | Buckley et al. | 446/83 |
| 2007/0049160 | A1 | 3/2007 | Matthes et al. | |
| 2007/0149090 | A1 | 6/2007 | Hippely | |
| 2007/0197126 | A1 * | 8/2007 | Derrah | 446/288 |
| 2007/0293122 | A1 | 12/2007 | O'Connor et al. | |
| 2008/0051001 | A1 | 2/2008 | Nuttall et al. | |
| 2008/0070472 | A1 | 3/2008 | Campbell | |
| 2008/0070474 | A1 * | 3/2008 | Nuttall | 446/444 |
| 2008/0171491 | A1 * | 7/2008 | Sheltman | 446/429 |
| 2008/0265048 | A1 * | 10/2008 | O'Connor | 238/10 E |
| 2008/0268743 | A1 | 10/2008 | O'Connor et al. | |
| 2009/0072481 | A1 * | 3/2009 | Ostendorff | 273/246 |
| 2009/0149112 | A1 * | 6/2009 | Clark et al. | 446/437 |
| 2009/0176545 | A1 | 7/2009 | Civettini et al. | |
| 2009/0264046 | A1 | 10/2009 | Mayer | |
| 2011/0003532 | A1 * | 1/2011 | McCafferty et al. | 446/462 |
| 2011/0130068 | A1 * | 6/2011 | Nuttall et al. | 446/75 |
| 2011/0223829 | A1 * | 9/2011 | Sheltman | 446/444 |
| 2012/0088435 | A1 * | 4/2012 | Jourdian et al. | 446/444 |

* cited by examiner

TOY PLAYSET

CROSS REFERENCE TO RELATED APPLICATIONS

This application claims the benefit of U.S. Provisional Patent application Ser. No. 61/391,336, filed Oct. 8, 2011, the contents of which are incorporated herein by reference thereto.

BACKGROUND

Toy track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

Accordingly, it is desirable to provide a toy track set with unique play configurations.

SUMMARY OF THE INVENTION

In one embodiment, a play set configured for use with an item removably secured to a base item having a plurality of wheels and a ferromagnetic material disposed therein is provided. The play set having: a plurality of launchers each being configured to launch the item and the base item along one of a plurality of track segments, wherein each of the track segments terminate at a central area; and at least one magnet disposed in the central area, wherein the base item is attracted to the at least one magnet when it reaches the central area after traversing along one of the plurality of track segments.

In another exemplary embodiment, a play set configured for use with an item removably secured to a base item having a plurality of wheels and a ferromagnetic material disposed therein is provided, the play set having: a ring area; a platform located above the ring area; a track segment interconnecting the platform and a ring area; at least one wand member movably secured to the ring area; a magnet secured to the wand member, wherein the ferromagnetic material is attracted to the magnet when it reaches the ring area, wherein movement of the wand member will cause a corresponding movement of the item on a surface of the ring area.

In still another embodiment, a play set configured for use with an item removably secured to a base item having a plurality of wheels is provided, the play set having: a plurality of launchers each being configured to launch the item and the base item along one of a plurality of track segments, wherein each of the track segments terminate at a central area; and a carriage rotatably secured to the central area for movement between a first position and a second position, wherein the base item is attracted to the at least one magnet when it reaches the central area after traversing along one of the plurality of track segments, wherein the carriage is configured to receive the item therein and the carriage rotates from the first position to the second position after the item is received therein.

DETAILED DESCRIPTION

Figure 1:
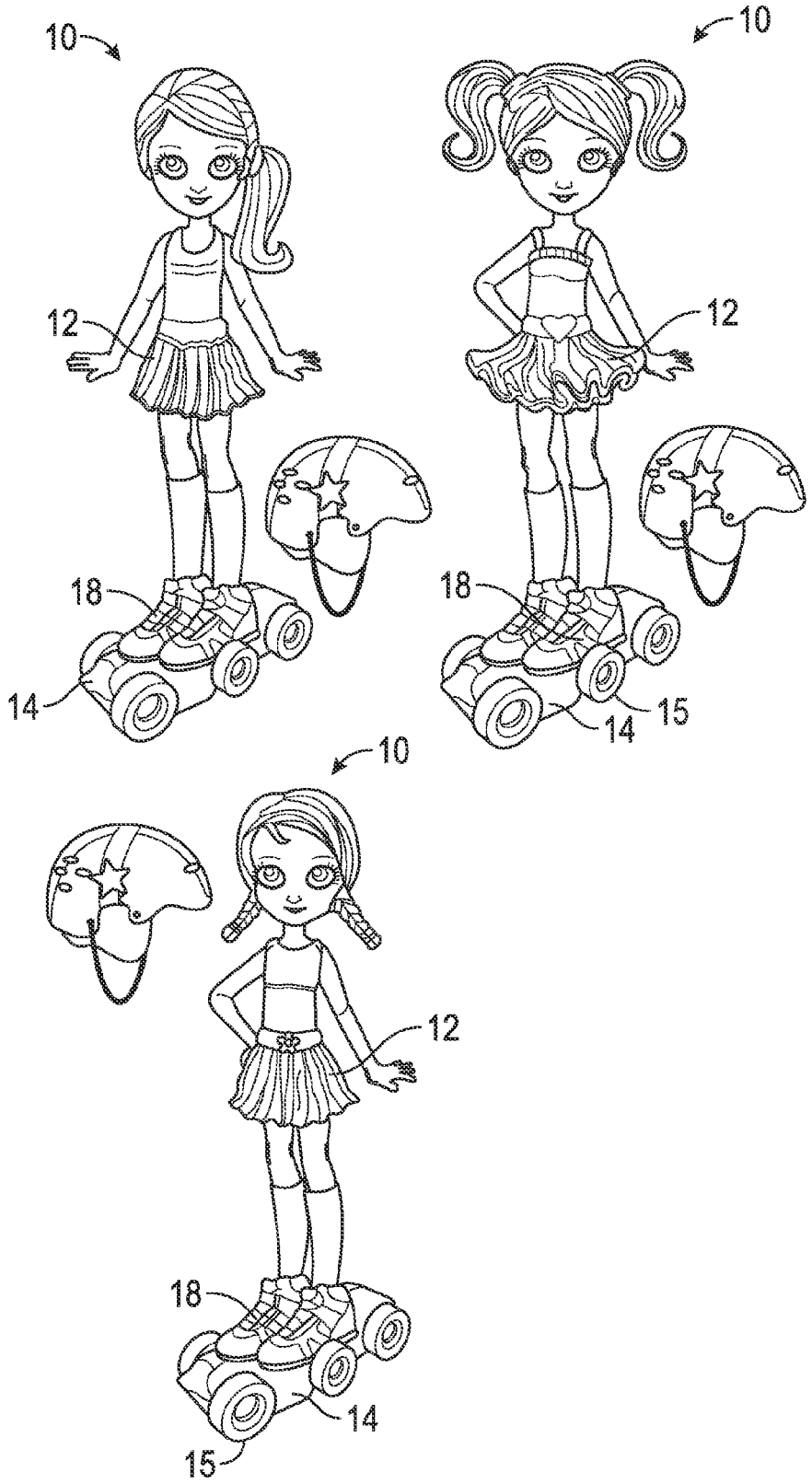
FIGS. 1-1C illustrate characters or figures contemplated for use with exemplary embodiments of the present invention.
Figure 1A:
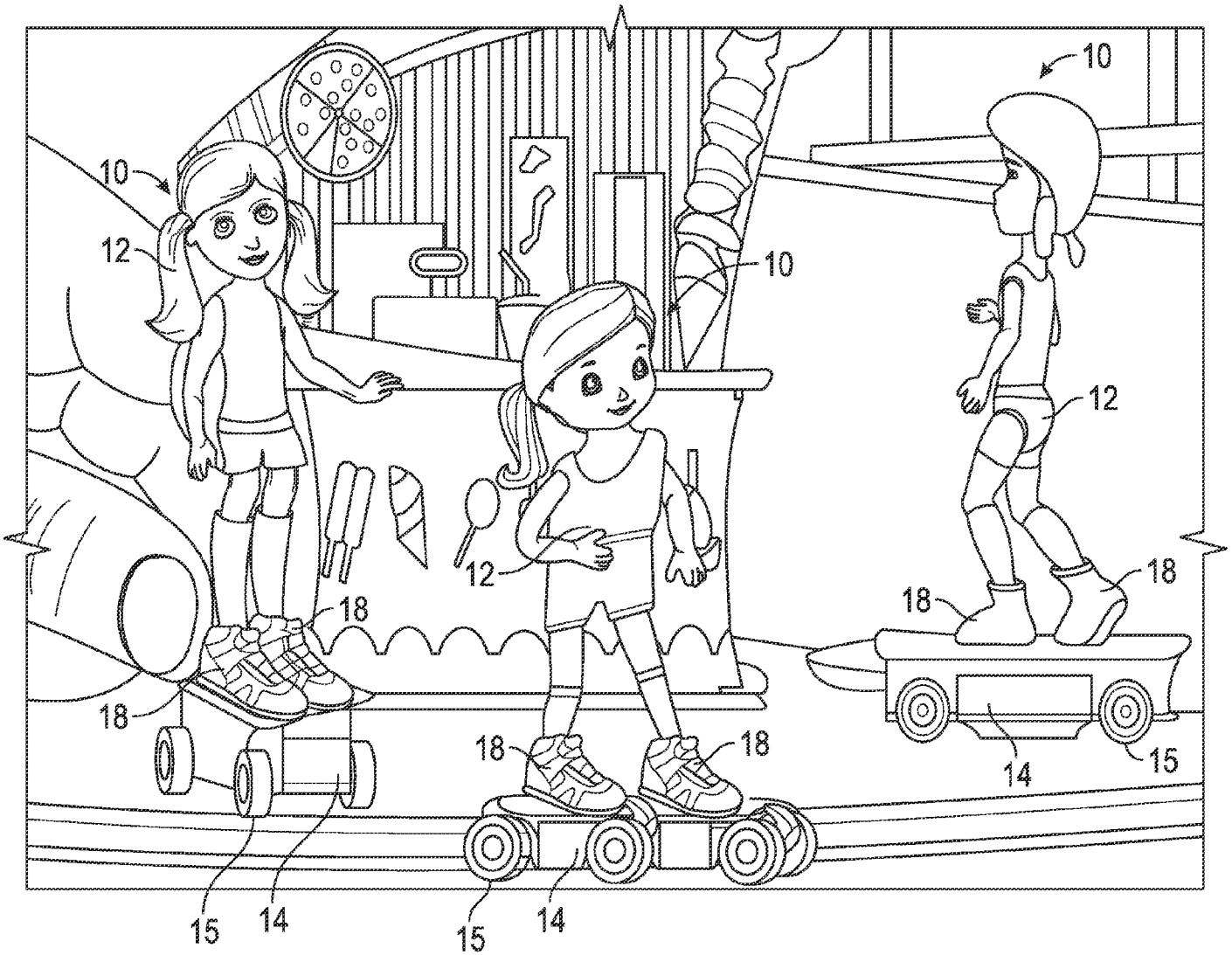
Figure 1B:
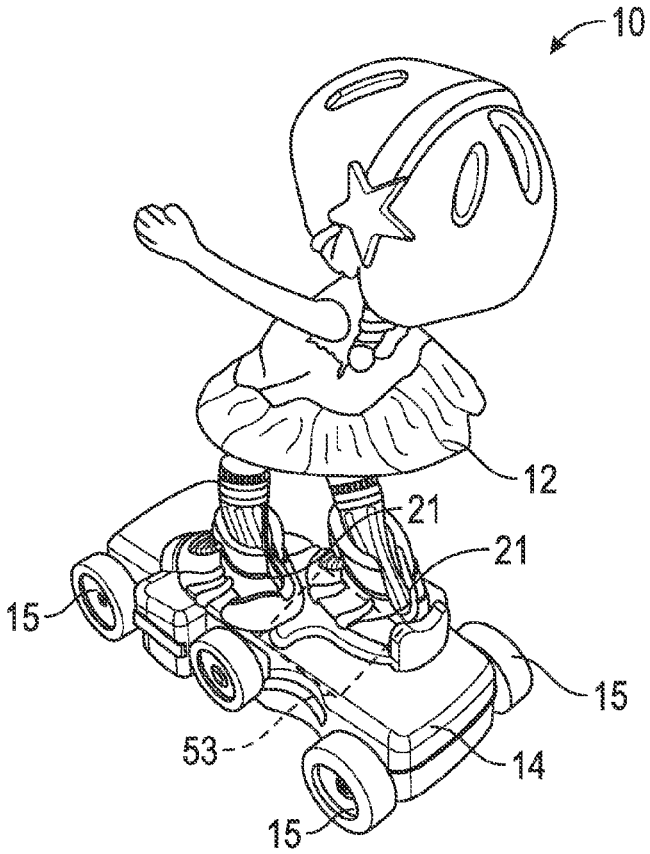
Figure 1C:
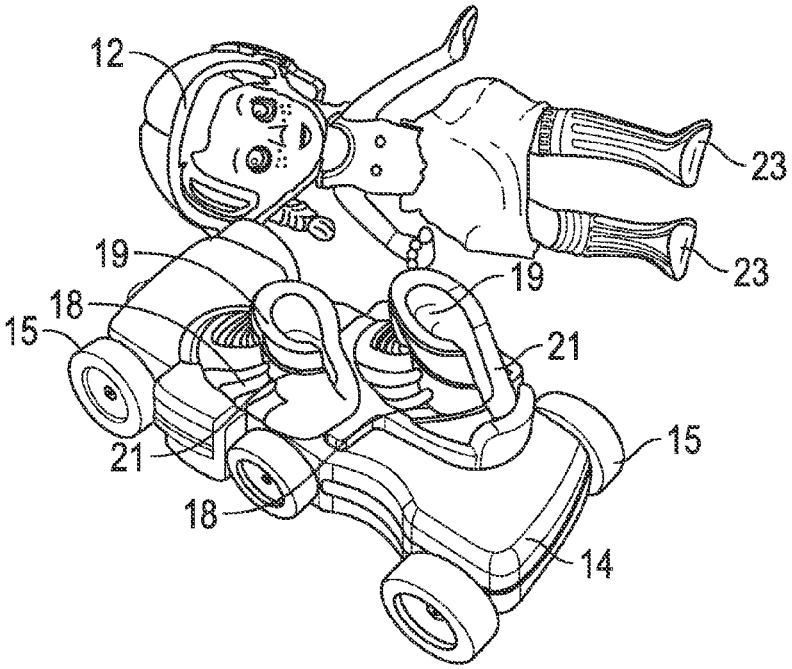
Figure 2:
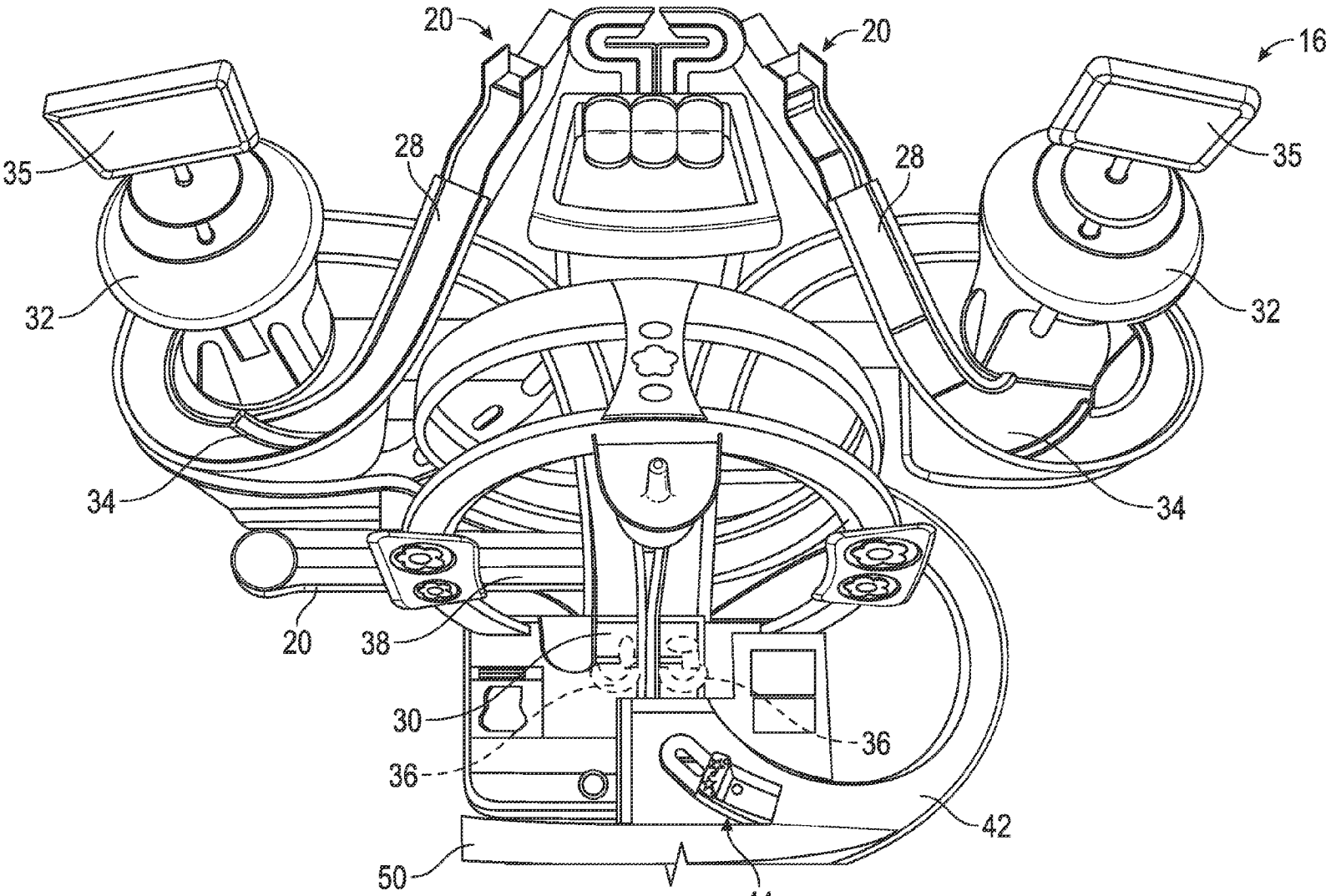
FIGS. 2-6 illustrate a play set in accordance with one embodiment of the present invention.
Figure 3:
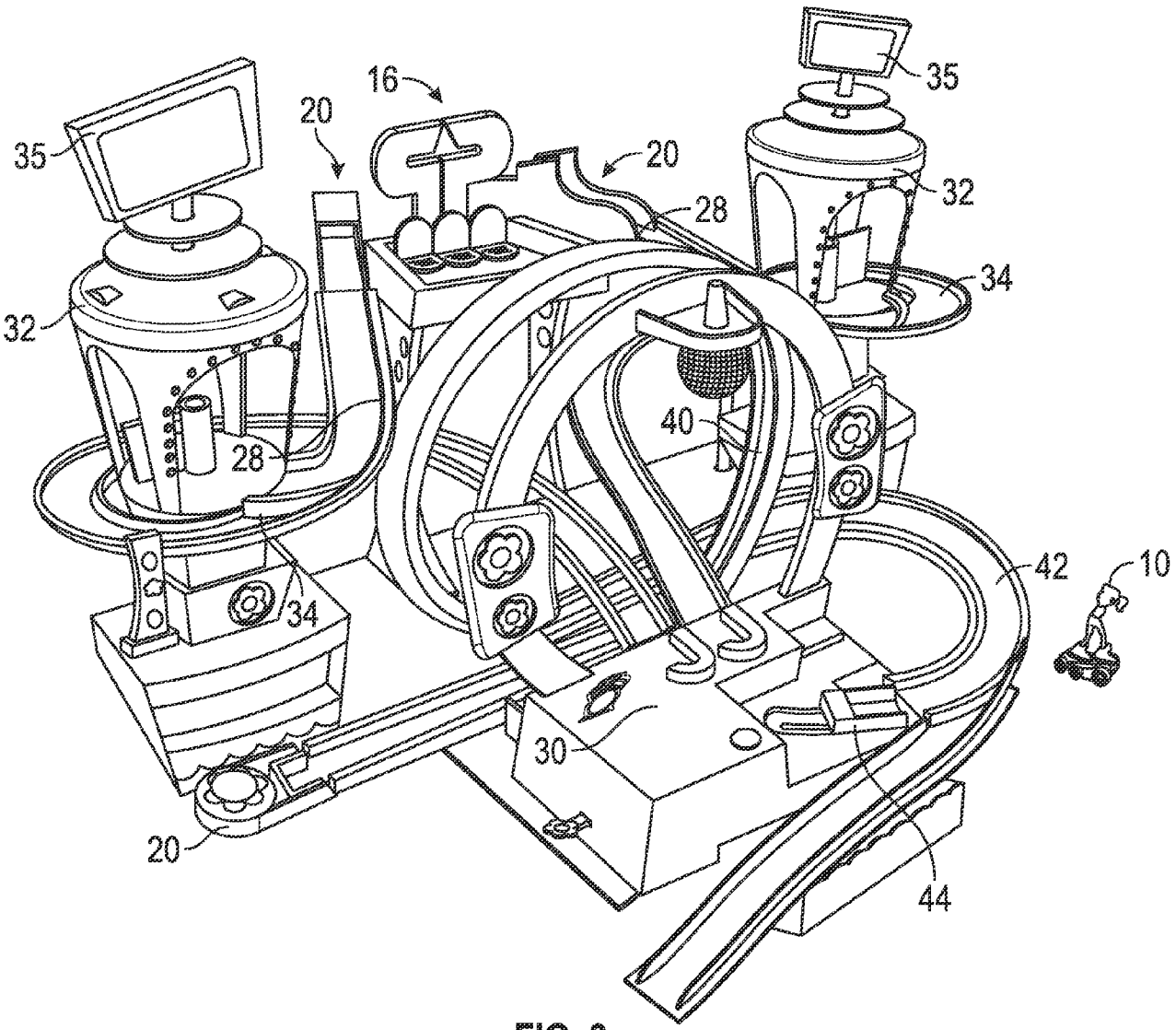
Figure 4:
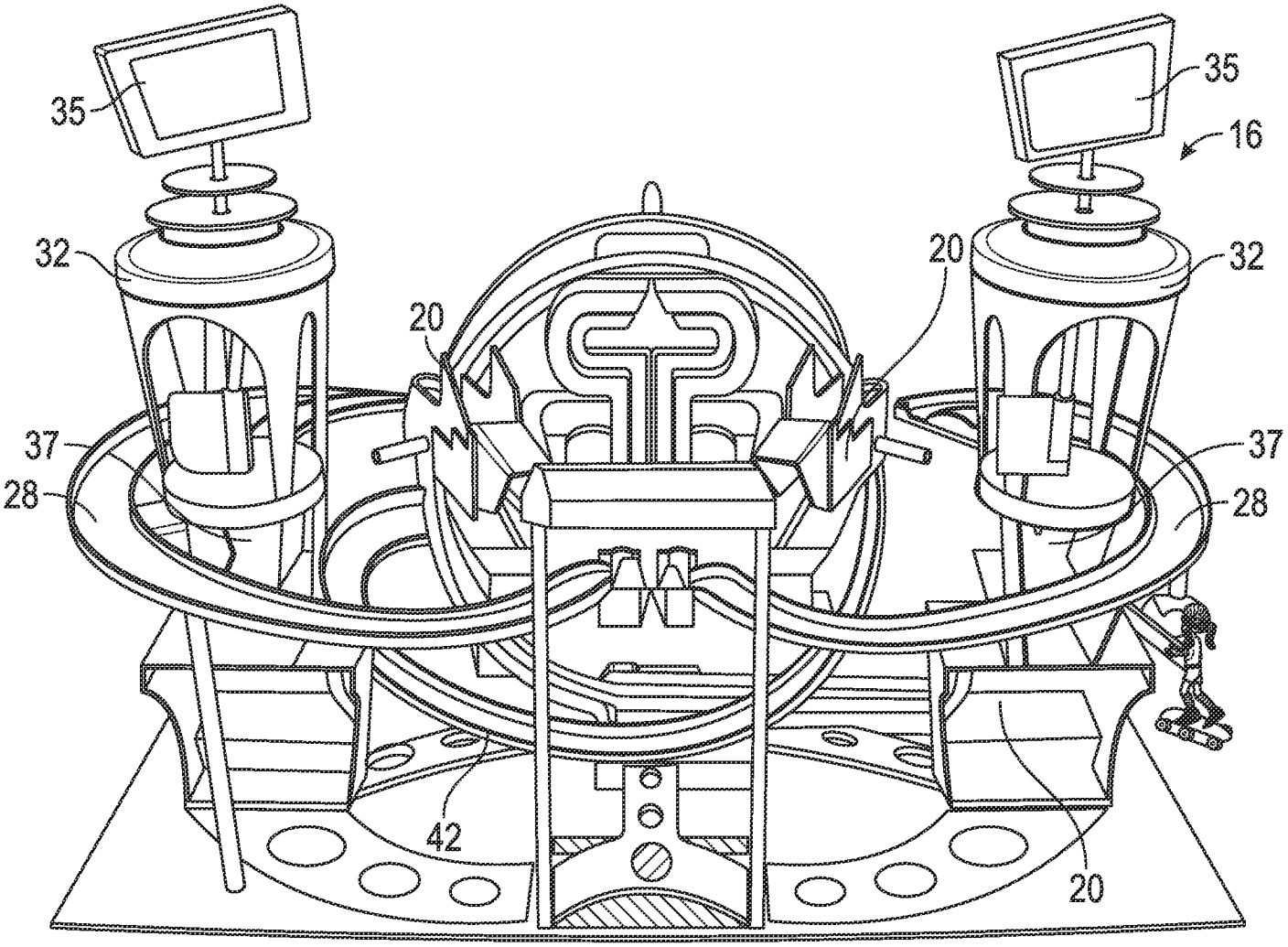
Figure 5:
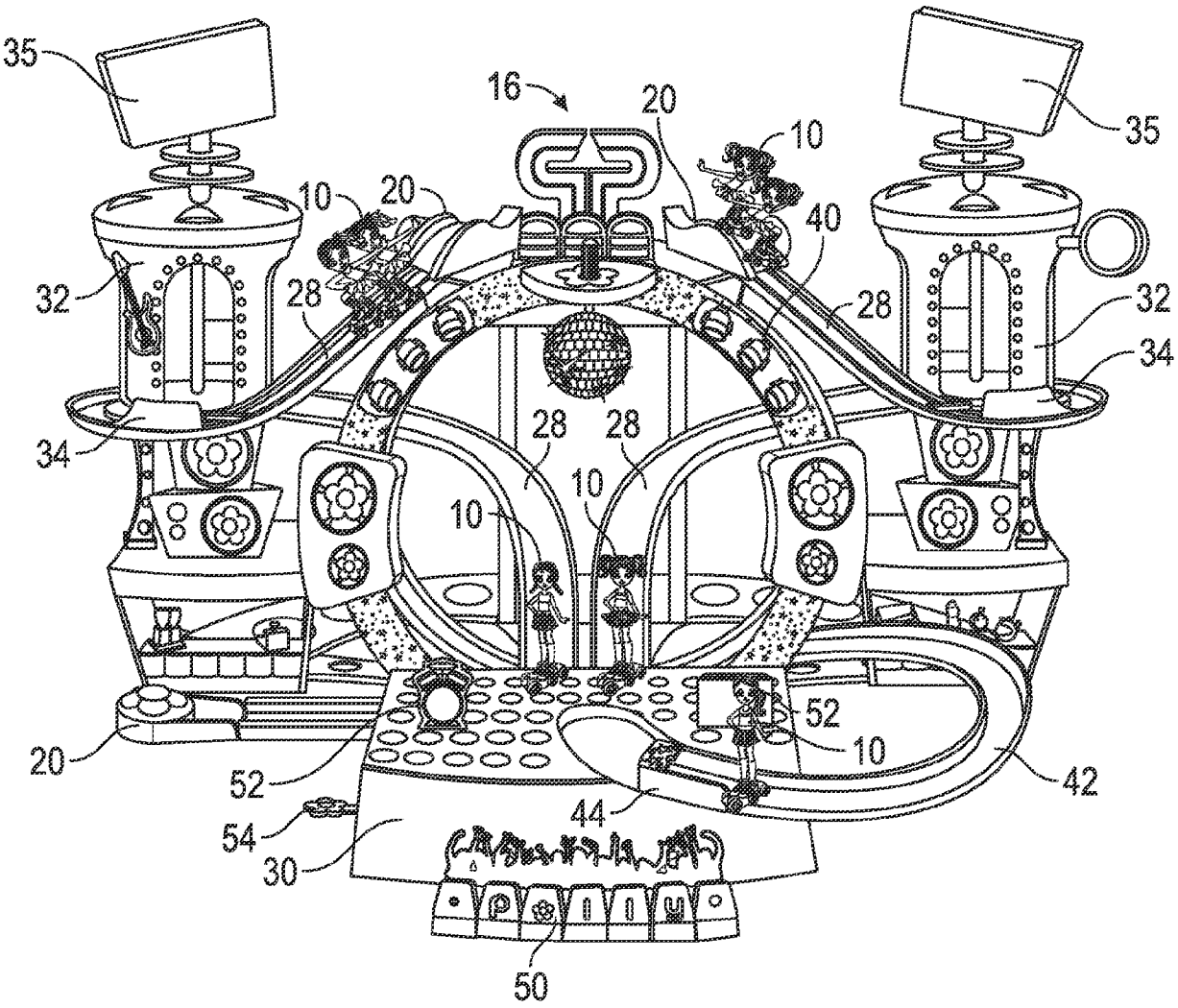
Figure 6:
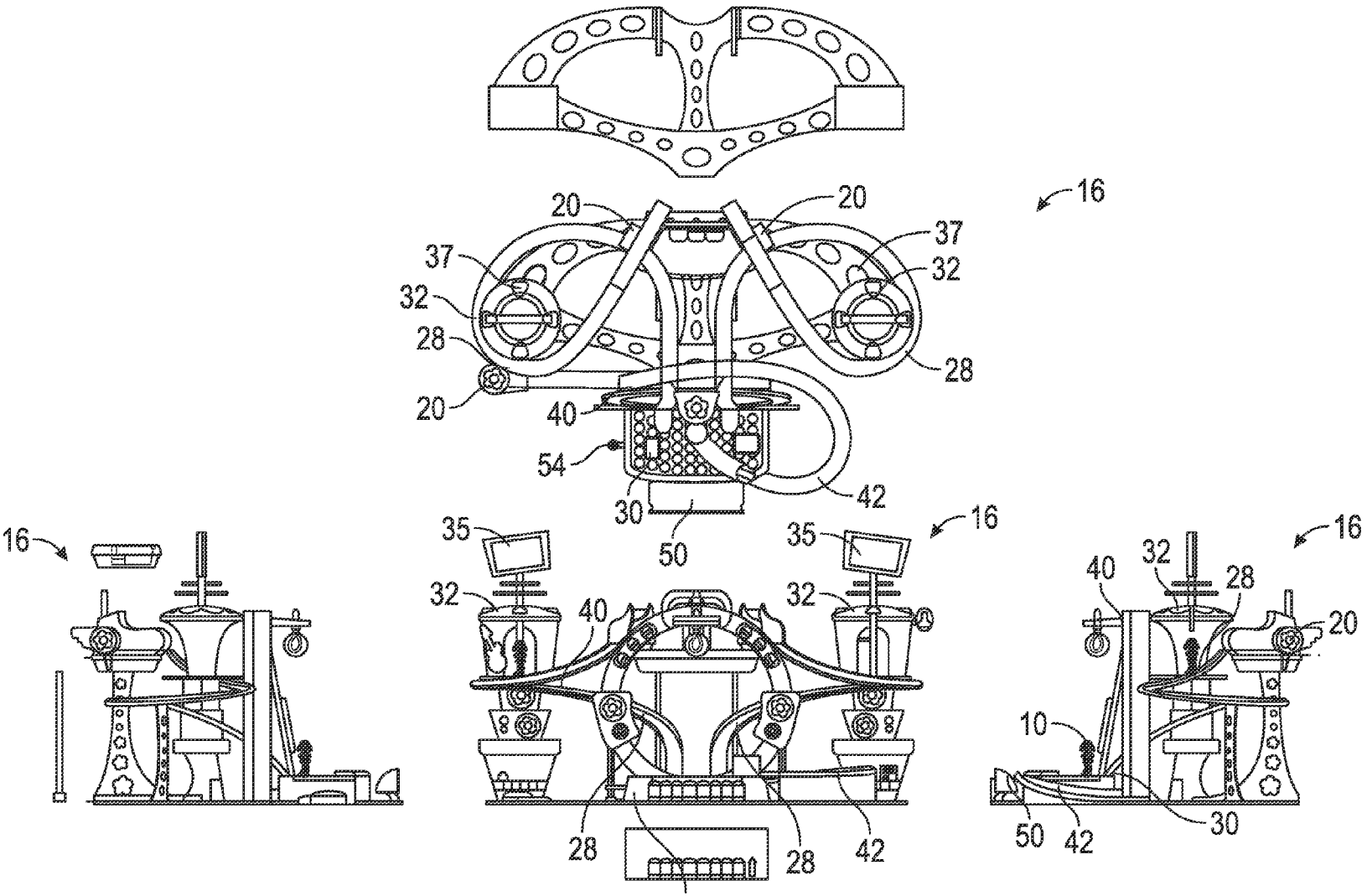

Referring now to the FIGS. and in accordance with various exemplary embodiments of the present invention toy play sets are provided. As illustrated, each toy play set is configured to be used with a plurality of characters or figurines 10 that are configured to be launched along one of a plurality of track paths of the play set (see at least FIGS. 1-1C). In one embodiment, a character 12 is removably mounted to an item 14 that is configured to traverse along portions of a play set 16. In one embodiment, the item is a skateboard having a plurality of wheels 15 and the figurine or character 12 is removably mounted to the skateboard by engaging a pair of sneakers, shoes, boots or any other feature 18 having a cavity 19 that is fixedly secured to the skateboard and allows insertion and removal of a portion of the figure therein. Wheels 15 allow item 14 and figurine 10 to travel along anyone of a plurality of tracks of the toy play set. One non-limiting material for sneakers 18 is a rubber material directly or insert molded into a surface of the skateboard or item 14. Alternatively, sneakers 18 are formed from a flexible plastic material such that the feet of the character or figure can be removably inserted therein. Of course, any other suitable material is considered to be within the scope of exemplary embodiments of the present invention.

The sneakers or other feature 18 having cavity 19 may also include one or more slits or openings 21 to facilitate insertion or removal of the figure from the feature while still retaining the figure therein. As illustrated in at least FIGS. 1B and 1C, the slits or openings 21 are located at a rear portion of the item 14 such that the feet 23 of the figure or character 12 can removably engage the sneakers or shoes 18 integrally molded with item 14. Alternatively, the figure or character can be fixedly secured or molded to the skateboard or other equivalent item configured to traverse along portions of the play sets.

Accordingly, the figurine, character or doll can be played with separately and then the doll can be snapped or otherwise removably affixed to the skates or other vehicle 14 with wheels 15 (i.e., skateboard, snowboard, surfboard, scooter, etc.). The skateboard and the doll or figure will also be configured such that the doll has a high CG (center of gravity) with respect to the skateboard or item it is secured to. Therefore, the doll and the skateboard or other wheeled vehicle is able to traverse along portions or tracks of the play set and perform stunts such as loops, jumps, 360's and 720's or any other equivalent stunt. In one embodiment, the character is propelled along portions of the play set using a stored energy launcher 20, gravity, or both. In order to provide the biasing force for urging the character from the launcher a biasing element is secured to the launcher, which in one embodiment may be an elastic member.

Of course, it is understood that any biasing element can be used, non-limiting examples include springs, resilient members and equivalents thereof. Still further, non-limiting examples of launchers used in play sets are found in U.S. Pat. Nos. 4,108,437 and 6,435,929 and U.S. Patent Publication 2007/0293122 as well as those known to those skilled in the related arts.

Figure 7:
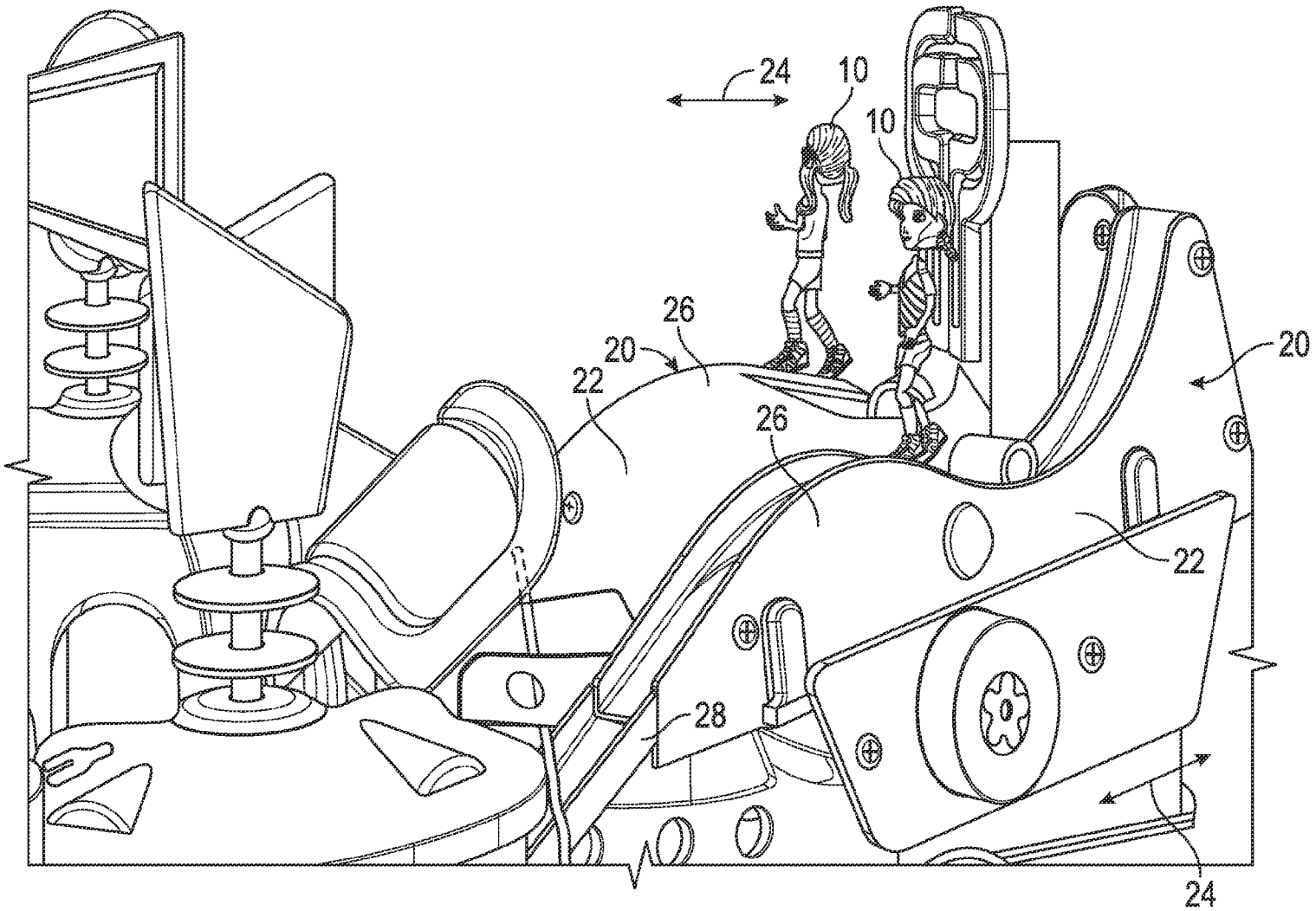
FIGS. 7-14E are various views of various embodiments of the play set illustrated in FIGS. 2-6.

In one embodiment and referring now to FIG. 7 a launcher 20 is illustrated. Here reciprocal movement of a base member 22 of the launcher in the directions of arrows 24 through actuation of a knob or other equivalent member will cause item 10 to slide back and forth until enough momentum is generated to cause the item to travel over a hill portion 26 and down a track segment 28 coupled to the launcher. Alternatively, launcher 20 is spring biased in a first direction wherein movement of the launcher in a direction opposite to the first direction and subsequent release of the launcher will cause the same to travel in the first direction and item 10 travels down track segment 28.

Figure 7A:
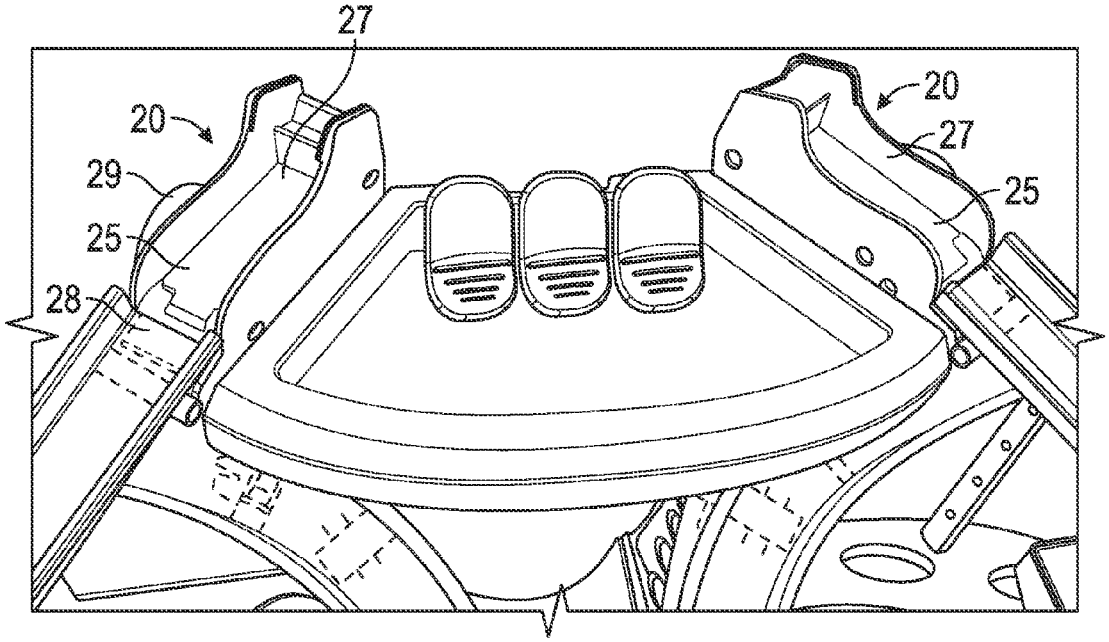
Figure 7B:
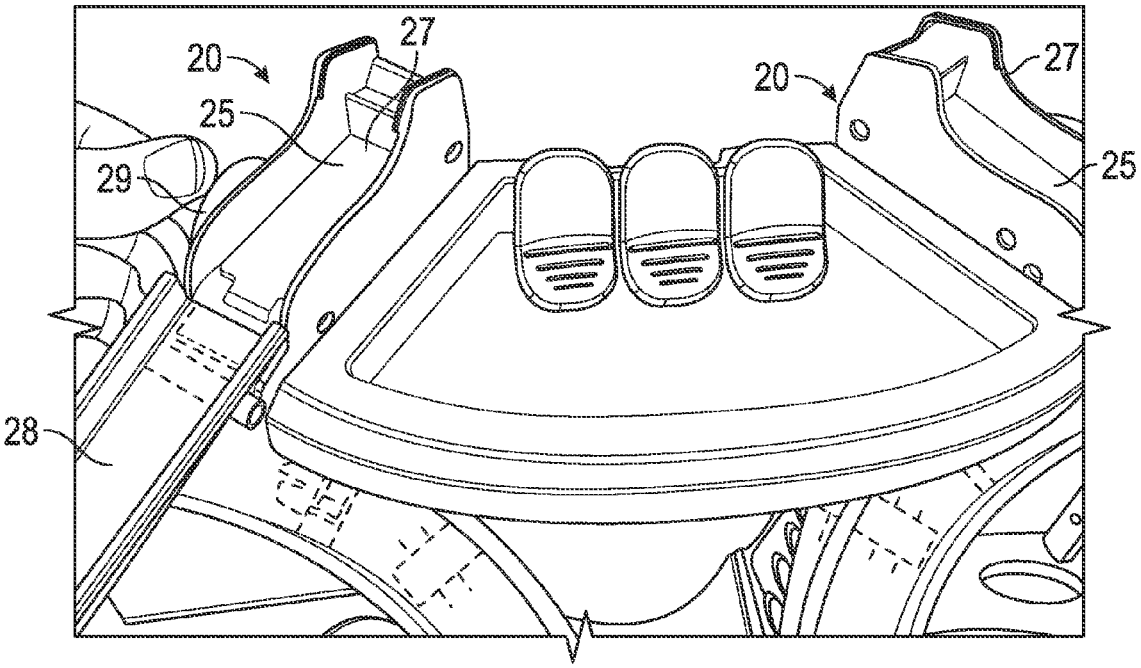
Figure 7C:
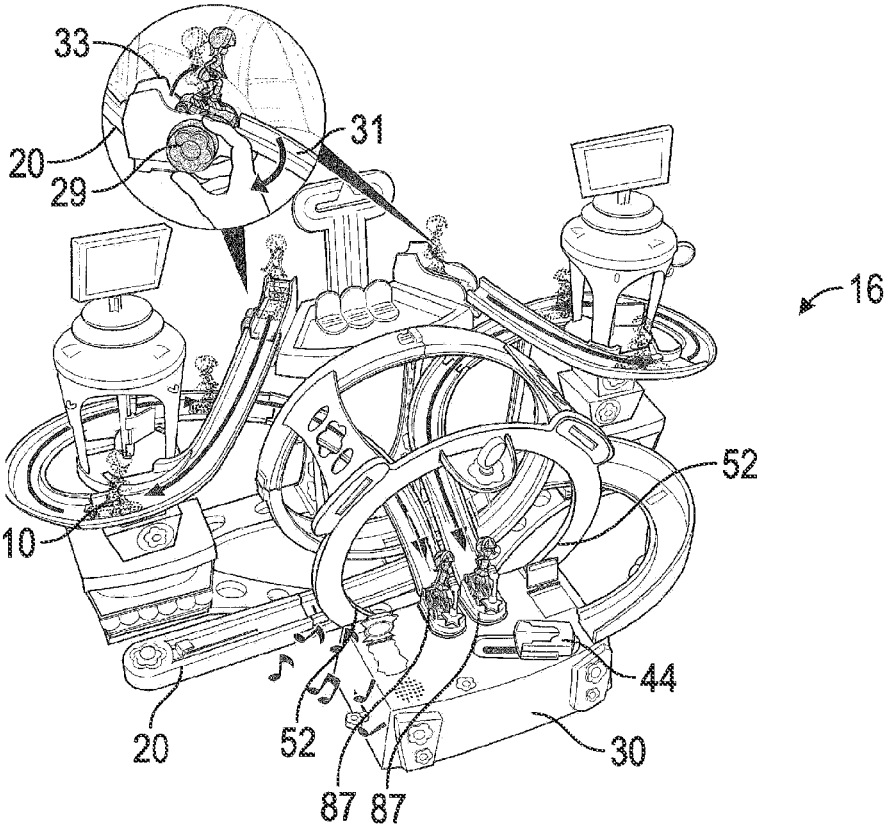
Figure 7D:
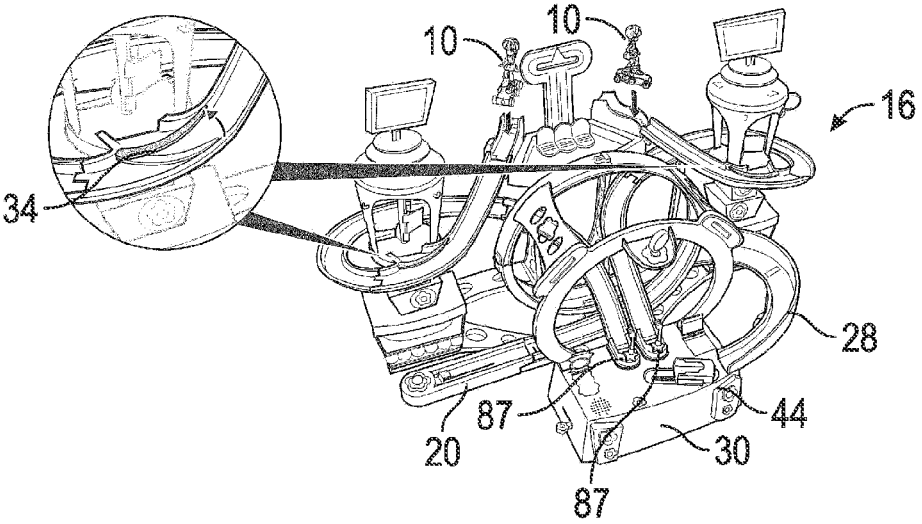

Alternatively and referring now to FIGS. 7A and 7B as well as the enlarged section of FIG. 7C, launcher 20 has a track portion 25 pivotally secured to launcher 20 for movement between a first position FIG. 7A and a second position FIG. 7B, as track portion 25 moves from the first position to the second position a rear portion 27 is lifted upwardly such that track portion 25 is now downwardly inclined so that the toy figures or characters 10 will travel downwardly due to gravity forces and the presence of wheels 15 on item 14 to which character 12 is secured. In order to facilitate the movement of track portion 25 from the first position to the second position a knob 29 is rotatably secured to launcher 20 proximate to track portion 25. Knob 29 is also secured to a cam member (not shown) that is located below track portion 25 such that as knob 29 is rotated in the direction of arrow 31 rear portion 27 of track portion 25 is moved upwardly in the direction of arrow 33.

As illustrated in at least FIGS. 2-6, each track segment 28 defines a path that terminates in a central area or central base 30. Located between central area 30 and launcher 20 are intermediary stations 32 which are configured to receive item 10 from a track segment 28 if a track diverter 34 is positioned to divert item 10 into station 32. Stations 32 can be configured to resemble features of an overall theme of the play set for example, stations may resemble shops that the figure can stop in to purchase items and/or change clothing. In addition and in an alternative embodiment, stations 32 are coupled to another track segment such that when the item 10 is diverted into station 32 via the track diverter the item will travel into and through station 32 and ultimately arrive at central area 30 via an alternative track path. Of course, numerous configurations are contemplated to be within the scope of exemplary embodiments of the invention.

In one embodiment diverters 34 are pivotally secured to the play set such that they can be manipulated between a first position wherein the item is diverted from track segment 28 into station 32 and a second position wherein the item travels along track segment 28 to central area 30. In one implementation, diverters 34 are spring biased into either the first position or the second position. In another embodiment, diverters 34 may be simply moved between first and second positions by rotating a sign or other feature 35 rotatably mounted to the station that is coupled to diverter 34 via linkage such that movement of sign or feature 35 will cause diverter 34 to move between the first position in the second position. As described above and in one implementation, the diverter 34 will cause the item 10 to divert into a chamber/store of the station and the path of travel of the item will terminate in the chamber, store or station, and/or the diverter is configured to cause the item to roll through the store and reconnect with the main track section 28 by way of a short connecting track 37 from another other side of the chamber/store.

For example, diverter 34 will cause the item to travel from track 28 into station, store, chamber 32 and the same will provide a path from track 28 to an intermediary connecting track 37 that ultimately reconnects with track 28. Thus, item 10 can travel from launcher 20 via track 28 to central area 30 or alternatively item 10 can be diverted via diverter 34 into station/store/chamber 32 wherein travel may terminate or travel may continue to the central area 30 via an alternative path back to track 28. As illustrated, each station/story/chamber 32 has an inlet and in some instances an outlet such that the station can receive the item from the main track and provide an alternative path back to the main track and ultimately the central area via an outlet of the station that is coupled to track 28.

Figure 7E:
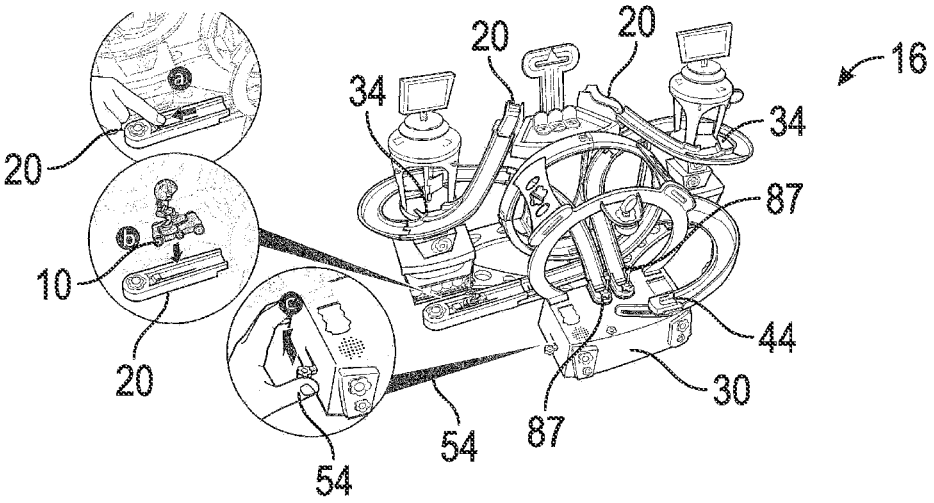
Figure 7F:
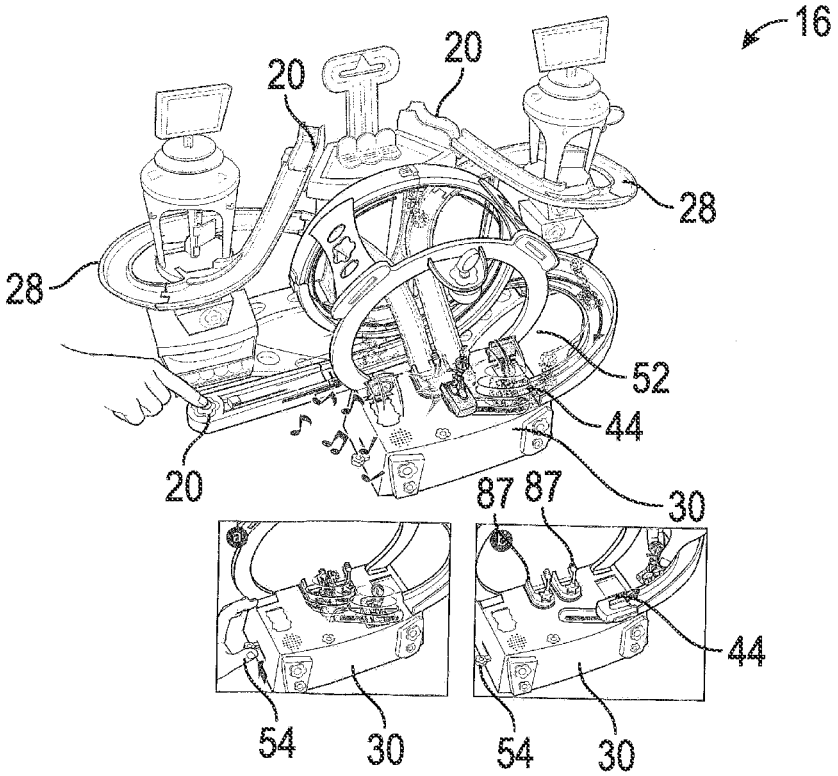
Figure 7G:
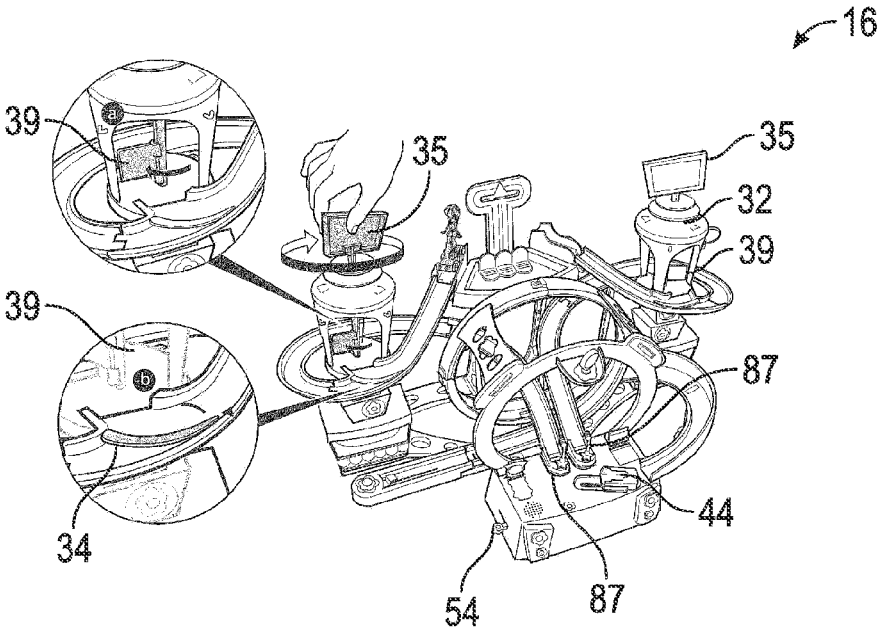
Figure 7H:
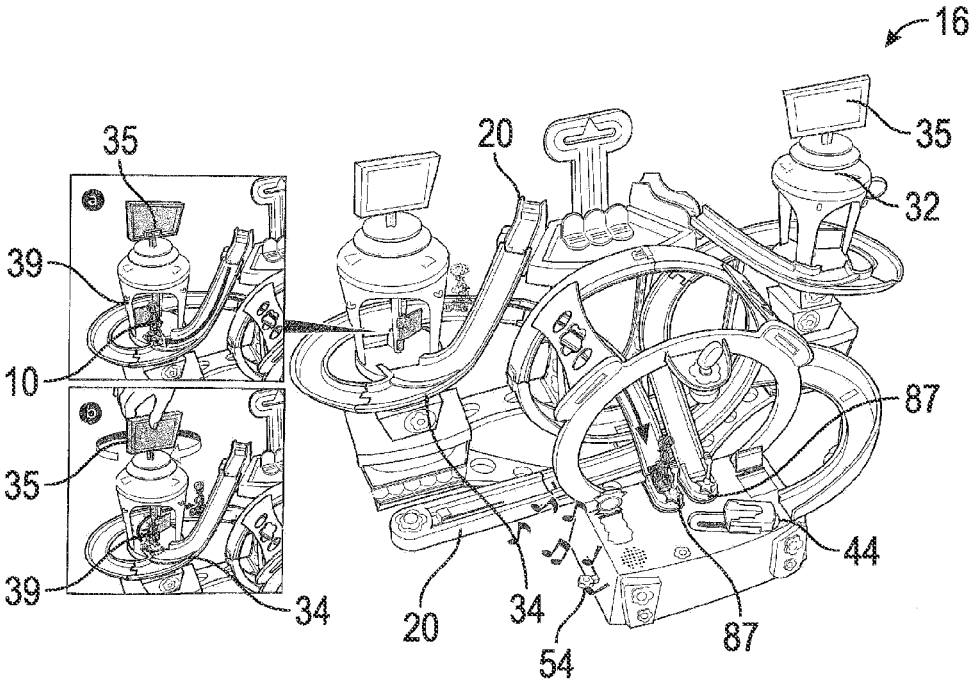
Figure 8:
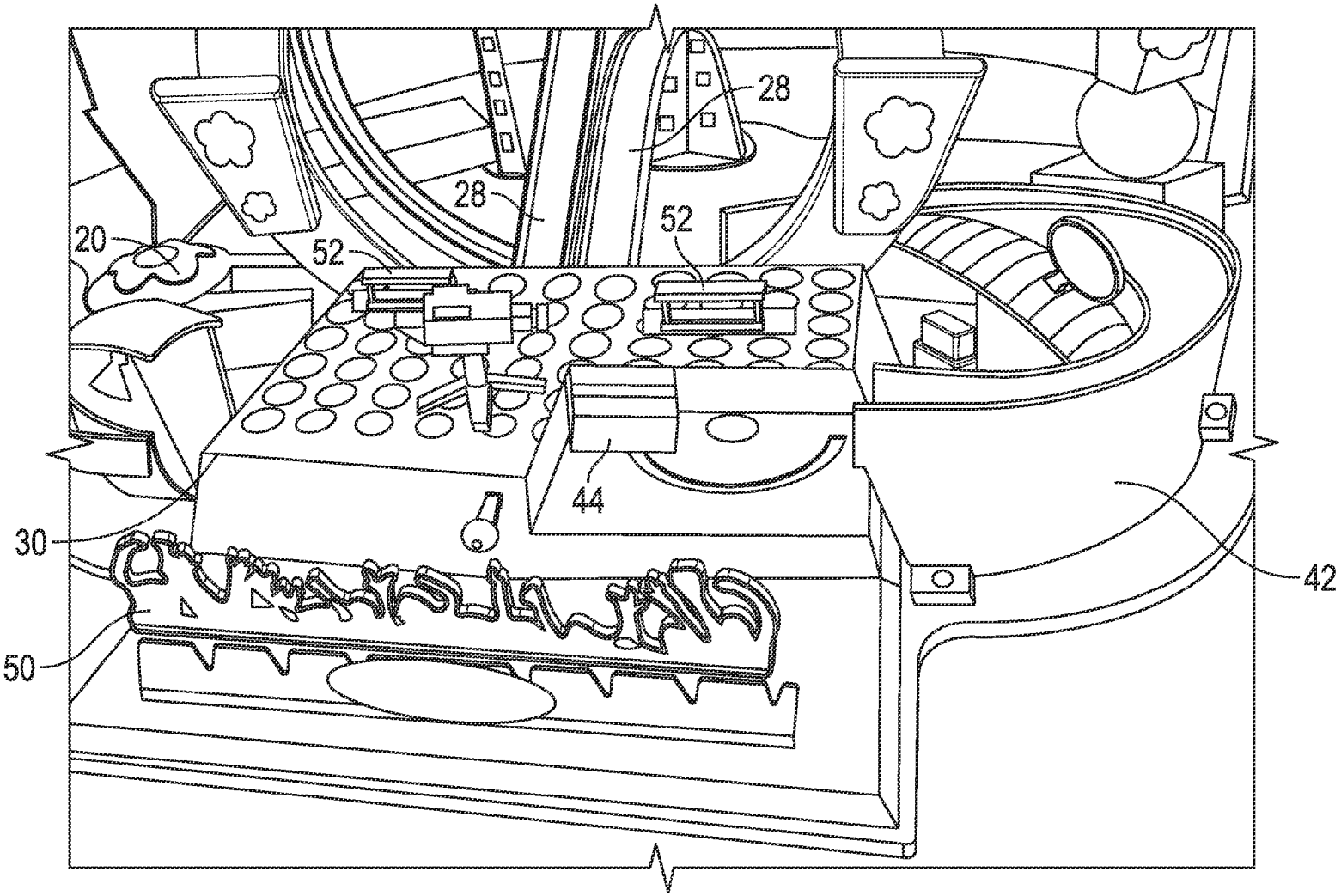
Figure 9:
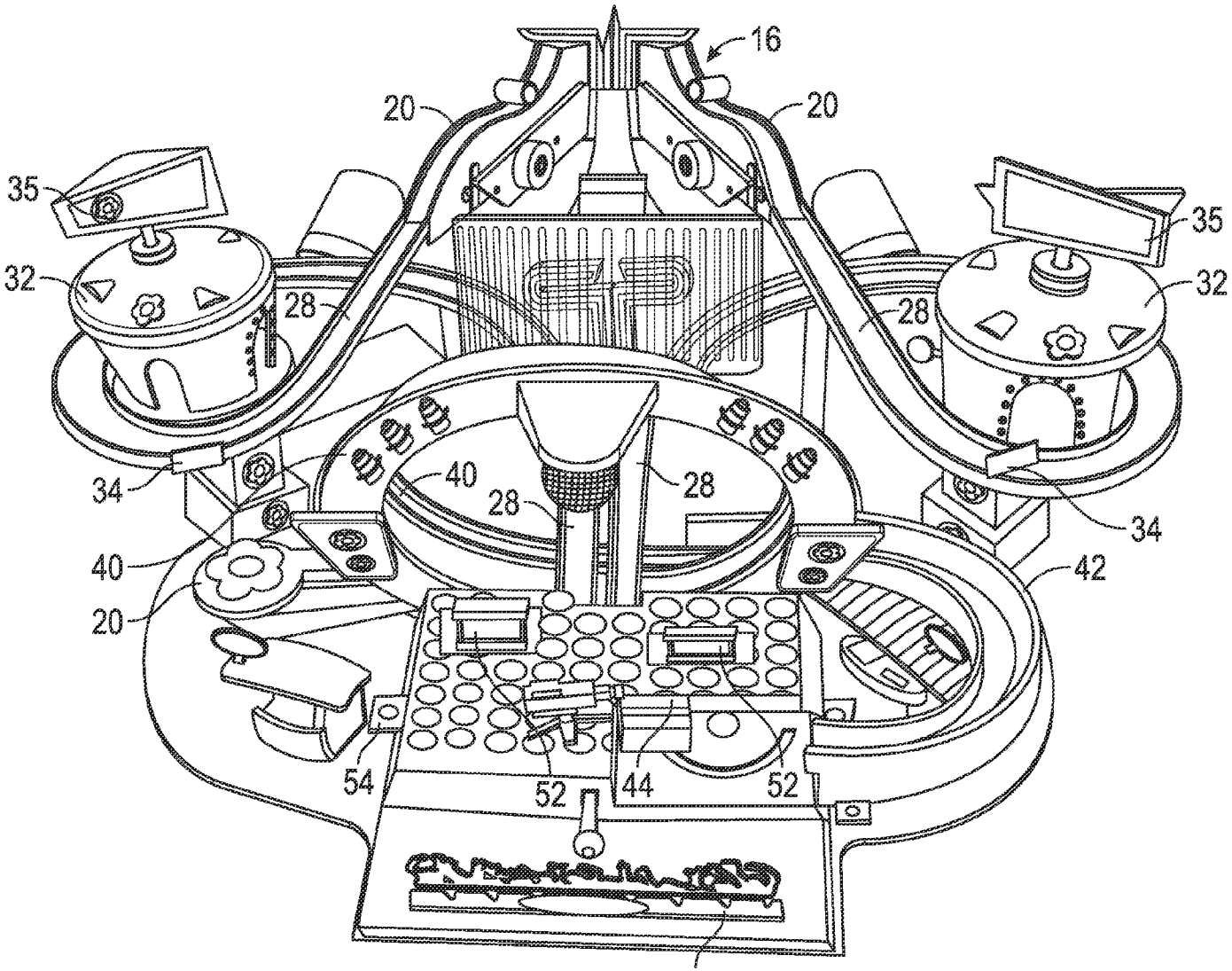

In yet another alternative embodiment feature or sign 35 is rotatably secured to each station/story/chamber 32 and is also coupled to a planar member or feature 39 such that rotation of sign or feature 35 as illustrated in at least FIGS. 7E and 7F will cause rotational movement of planar member or feature 39. In this embodiment, feature 39 is configured to either stop or push character 10 as it is traveling within each station/story/chamber 32. For example, and in one embodiment, when diverter 34 is positioned to direct character 10 into one of the station/story/chambers 32 the character may travel through a chamber 32 or stop therein due to the positioning of feature 39. If feature 39 is in the blocking position, character 10 will contact feature 39 as it enters chamber 32 thus causing character 10 to stop therein. Afterwards and when a user rotates sign or feature 35 in a first direction planar member or feature 39 will rotate away from character 10 and away from the blocking position. Thereafter and as a user continuously rotates sign or feature 35, feature 39 will continue to rotate until it is now behind character 10 and thus further movement or rotation of feature 39 will push character 10 out of chamber 32.

As illustrated, feature 39 is secured to sign or feature 35 via a shaft or other equivalent member 51. It is also understood that sign or feature 35 and its complementary feature 39 secured thereto are capable of movement in both a clockwise and counterclockwise direction. Moreover, and in one exemplary embodiment, diverter 34 is simply manually manipulated by a user between its first position and second position and features 35 and 39 are coupled to each other.

Still further, movement of the item along portions of the play set will provide enhanced game play wherein the item will also activate/trigger other items that may spin/pop up/flip over or other similar mechanical actions.

In addition and in one embodiment, the skateboard or wheeled vehicle 14 has a built in plate or metal member 53 comprising a ferromagnetic material that can be used in conjunction with magnets for stopping or moving skates along portions of the play set. For example, magnets 36 are disposed in central area 30 such that as the items (e.g., figures on skateboards) travel from launcher 20 along track segment 28 to area 30 magnets 36 will engage in ferromagnetic material in the item such that it will either stop in area 30 or slow down or be diverted as it passes through area 30 if the magnets are of a lesser strength.

In accordance with various alternative embodiments disclosed herein and in order to facilitate movement of the items on the track segments or surfaces of the play sets and/or terminate or stop movement of the items, magnets are disposed within the item for example, the skateboard and a complementary ferromagnetic material or a second magnet is used to attract the magnet in the item. Alternatively, each item can have a ferromagnetic material that is attracted to a magnet disposed within the play set. Still further the magnet or material disposed within the play set can be secured to movable items such that movement of the item will cause complementary movement of the skateboard, etc.

In addition and in other embodiments, the doll or character 10 on skates can also be used to activate electronics for sound and/or lights wherein movement of the doll or character 10 will cause actuation of a switch wherein audio outputs are provided.

As illustrated, the play set includes a plurality of tracks and a plurality of launchers (spring biased or otherwise) that launches the character and the skateboard along a track segment. In one embodiment, the launchers 20 disposed at the top of the play set include a sliding mechanism that is configured to provide reciprocal movement back and forth that will ultimately cause the skateboard and the character to overcome a hill portion and travel down the track segment and the track segments will terminate in a central area 30, which in one embodiment has magnets located therein to stop movement of the skateboarding characters by attracting the ferromagnetic material disposed in the skateboard. Alternatively, the central area or base 30 has a pair of stop members 87 for stopping the items 10 instead of the use magnets as mentioned above.

Still further, the play set can include various track paths with a variety of options wherein objects (e.g., character and skateboard) are placed on track paths and move in horizontal and vertical directions. In one embodiment, the pair of track segments are configured such that users can race each other by launching their own item down a respective track segment. Alternatively, the pair of items are simultaneously launched through a single actuator.

In addition and in one embodiment, a separate track segment 38 is provided with a separate launcher 20 wherein the item (e.g., character on skateboard) is launched into a loop 40 and a track segment 42 coupled to the loop directs the item into a rotatably mounted member 44 that carries the item from track segment 42 to the central area 30. In one contemplated embodiment, rotatably mounted member 44 is a carriage slidably and rotatably secured to the play set for movement between a first receiving position wherein the carriage is configured to receive the item from a distal end of the track segment 42 and a second ending position wherein the carriage is located proximate to the central area 30. In one embodiment, the carriage is configured to rotate about an axis as it moves from the end of the track segment to the central area. In this embodiment, the carriage may have a spring biased mechanism for moving the same from the first receiving position to the second ending position wherein the spring biased mechanism is actuated as the item is received in the carriage. Accordingly, the movable member or carriage will move from the track segment towards the central area while also rotating at the same time.

In one non-limiting configuration, the central area 30 resembles a stage 30 for receipt of the characters on it. In this embodiment, the play set will also include a faux audience 50 that pops up when the movable member has delivered the character or figure to the stage area. Still further, the central area or stage 30 may also have scenery such as musical instruments 52 that also pop up when the movable member reaches the second ending position proximate to the stage. In order to reset a mechanism that causes the instruments, the audience and the movable member to transition between the first receiving position and the second ending position a manual reset lever 54 is provided. Accordingly, the play set can be reset such that the audience and the instruments are returned to a stowed position and the movable member is returned to the receiving position such that upon receipt of item 10 into the carriage a trigger or release mechanism disposed therein will cause the mechanism to move the movable member from the first receiving position to the second ending position, which in one embodiment can be achieved through a spring biased mechanism having a releasable catch that is disengaged when the item is received into the movable member and the same moves to the second ending position.

Figure 10:
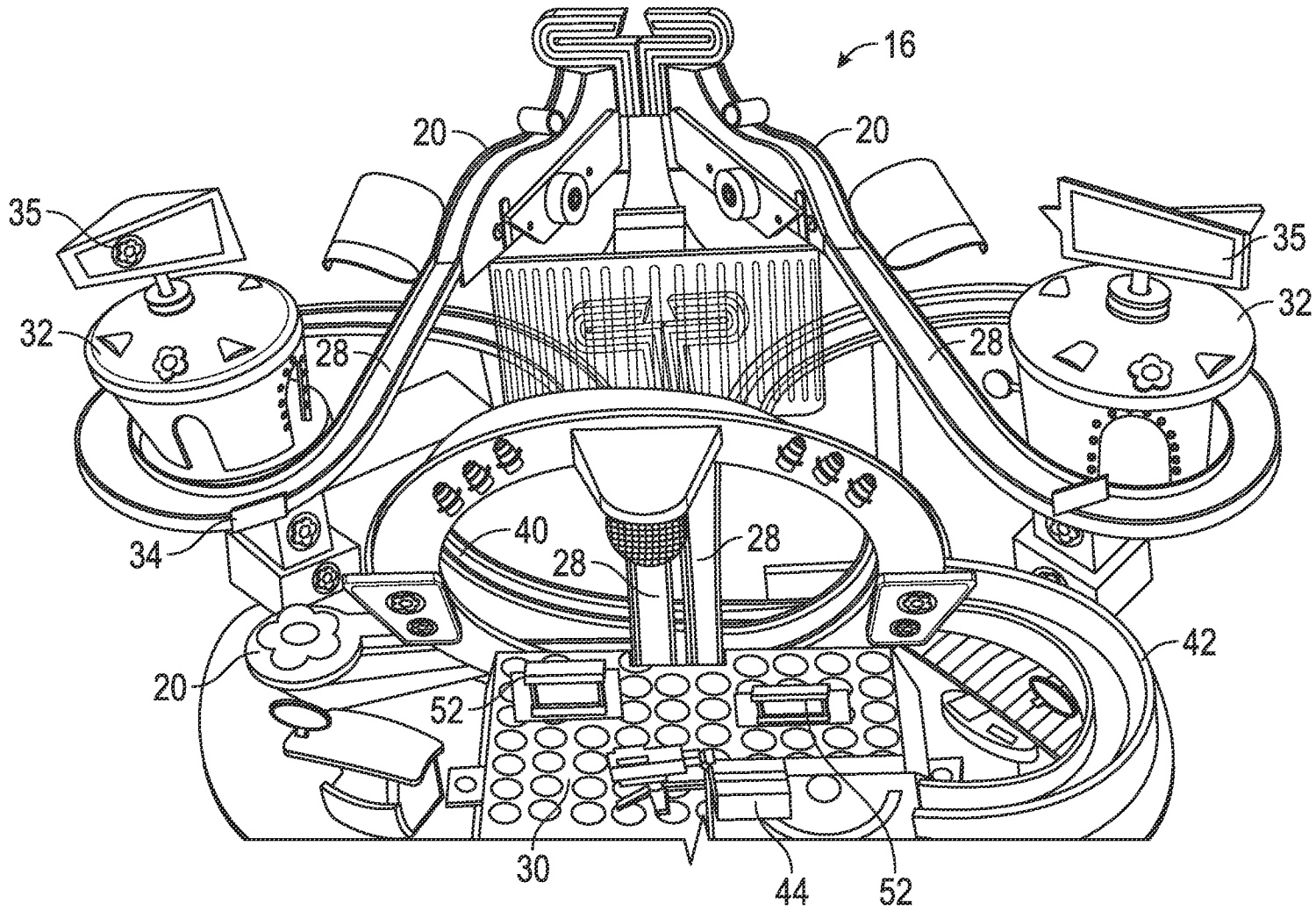
Figure 11A:
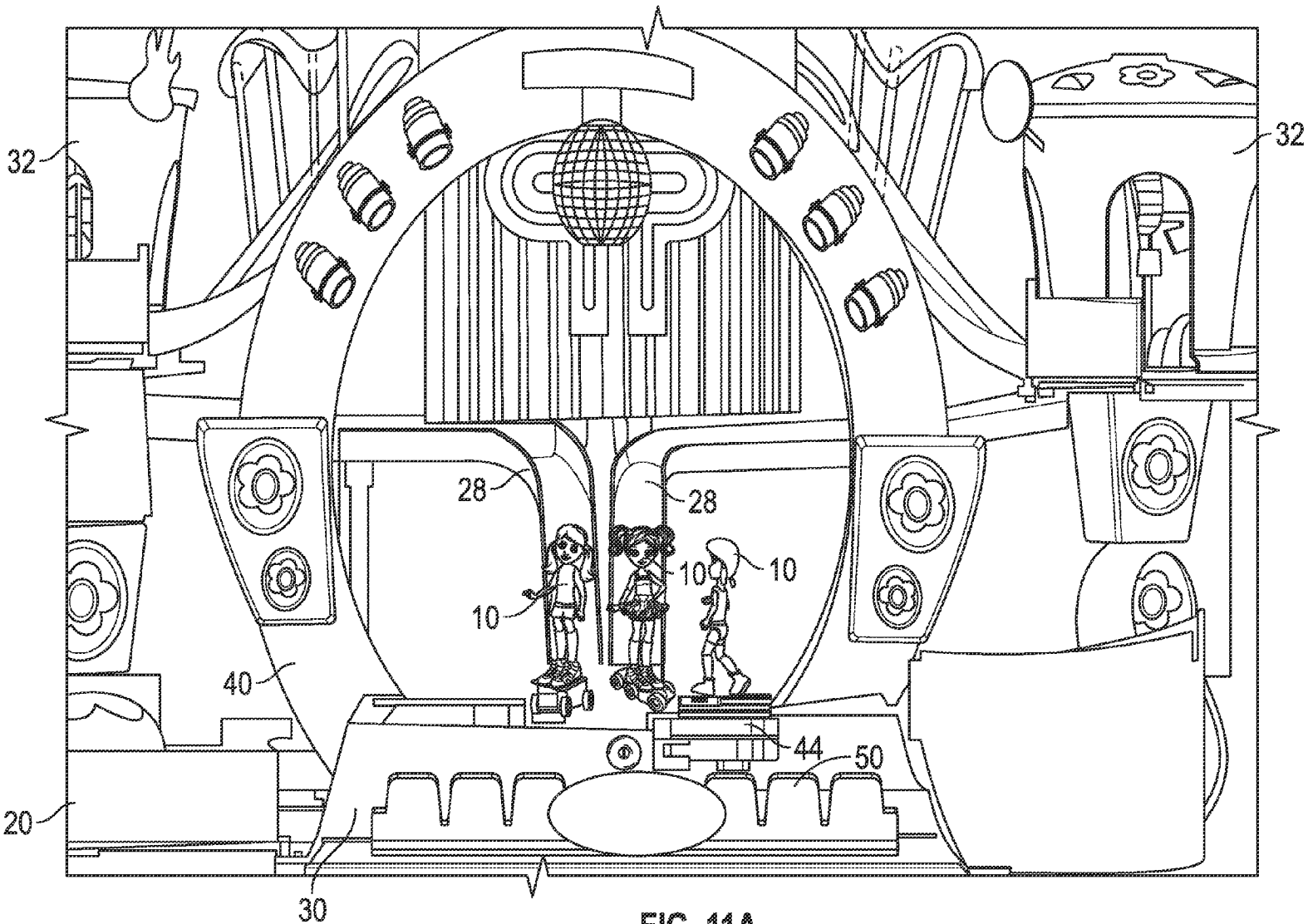
Figure 11B:
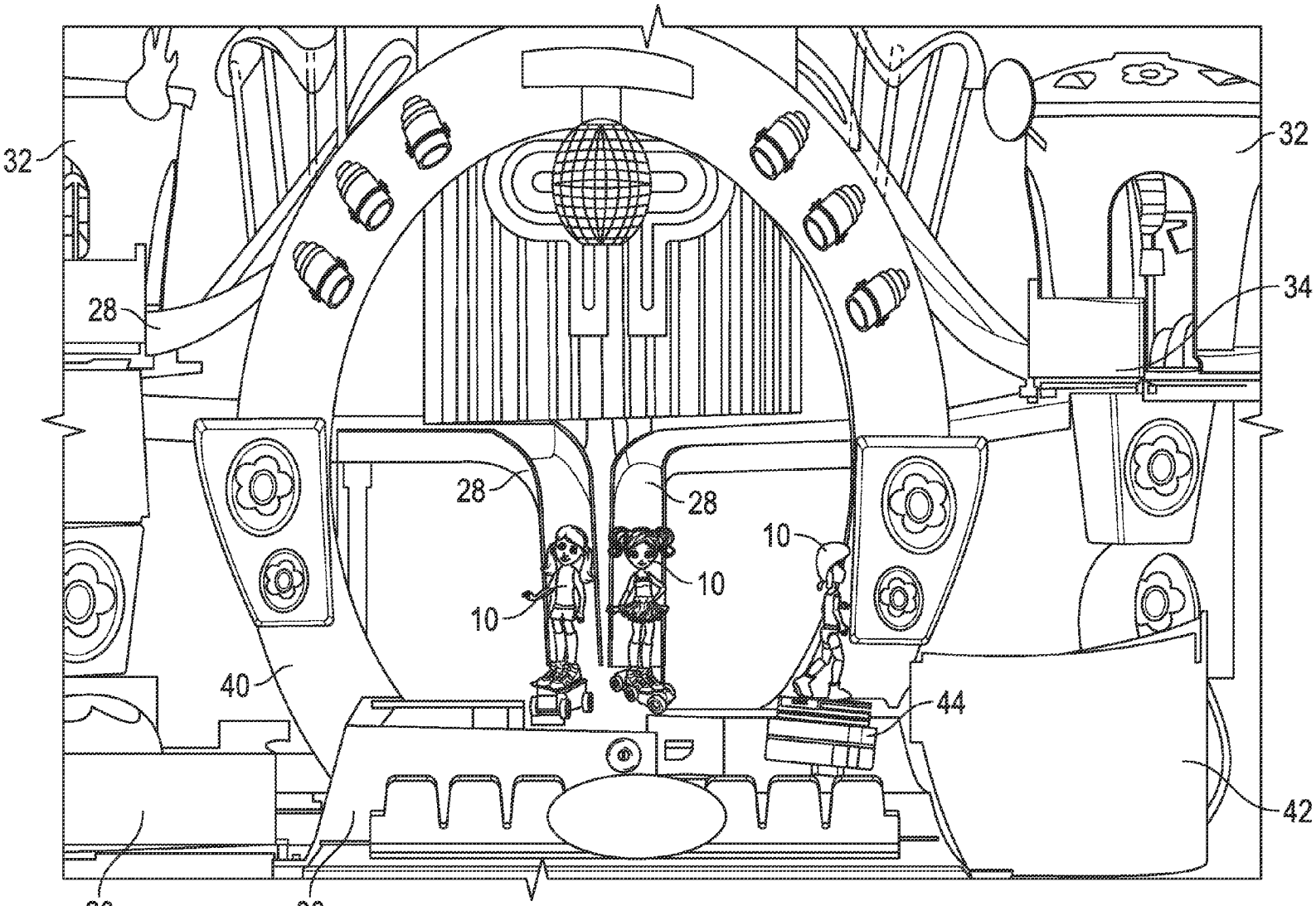
Figure 11C:
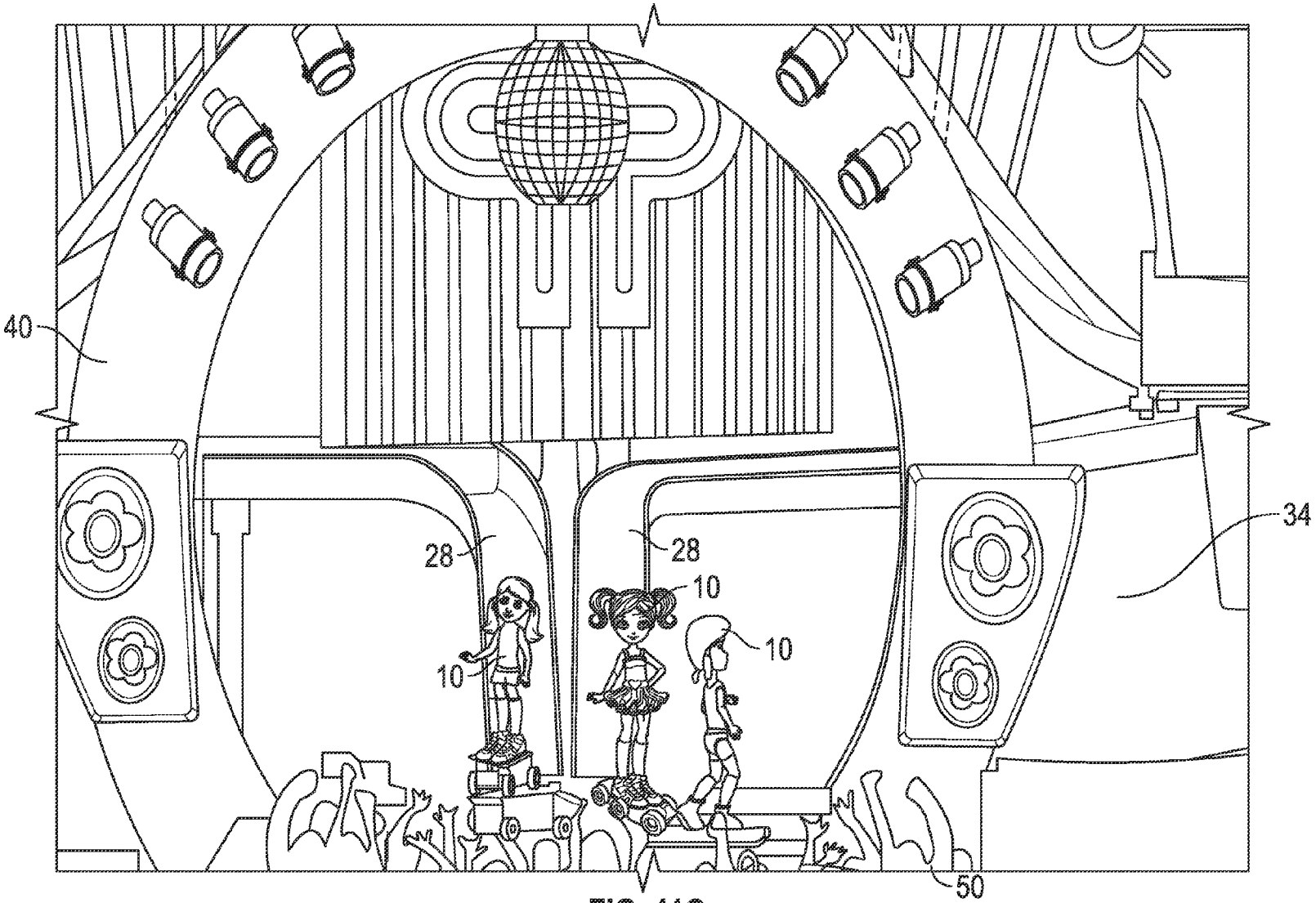
Figure 12A:
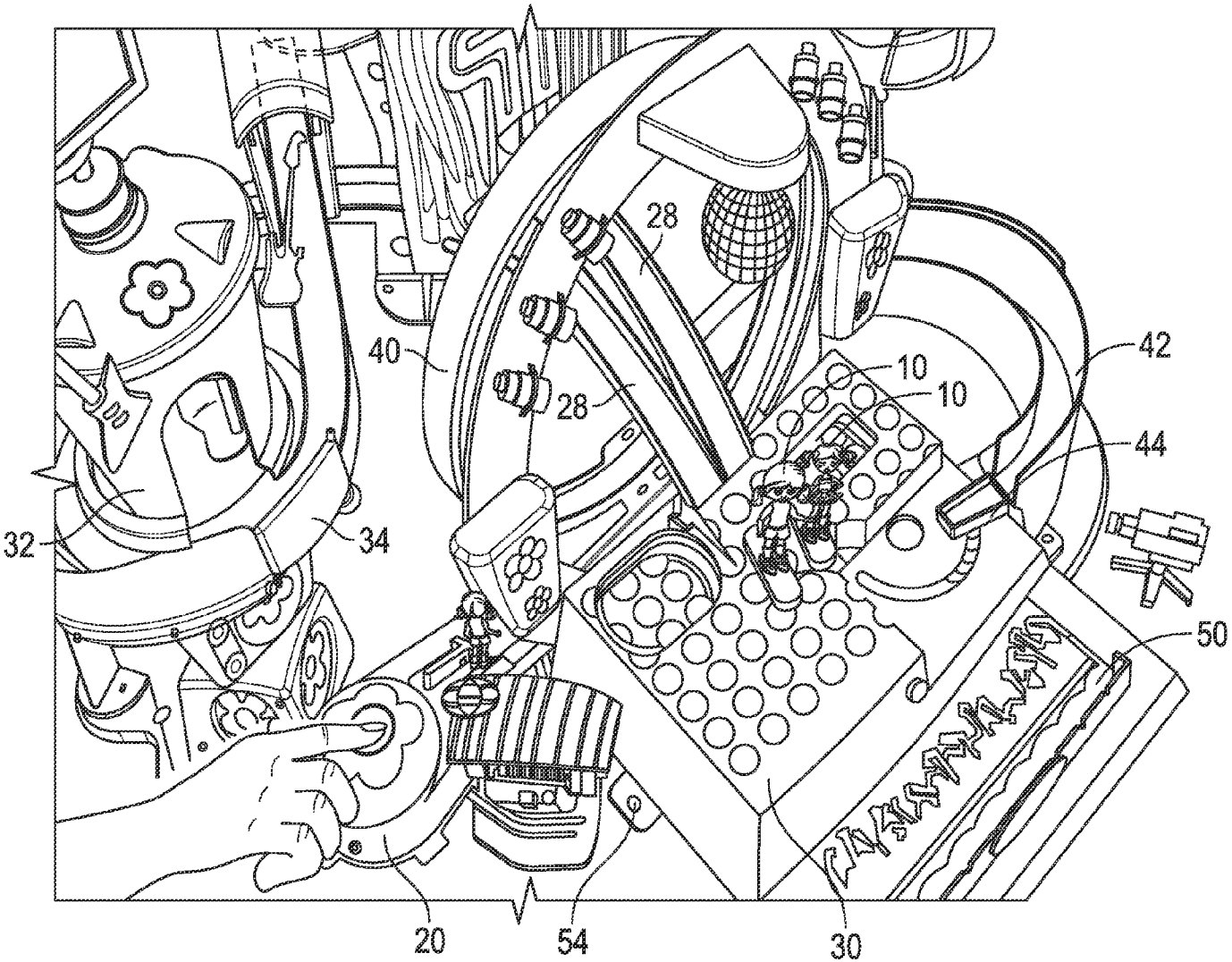
Figure 12B:
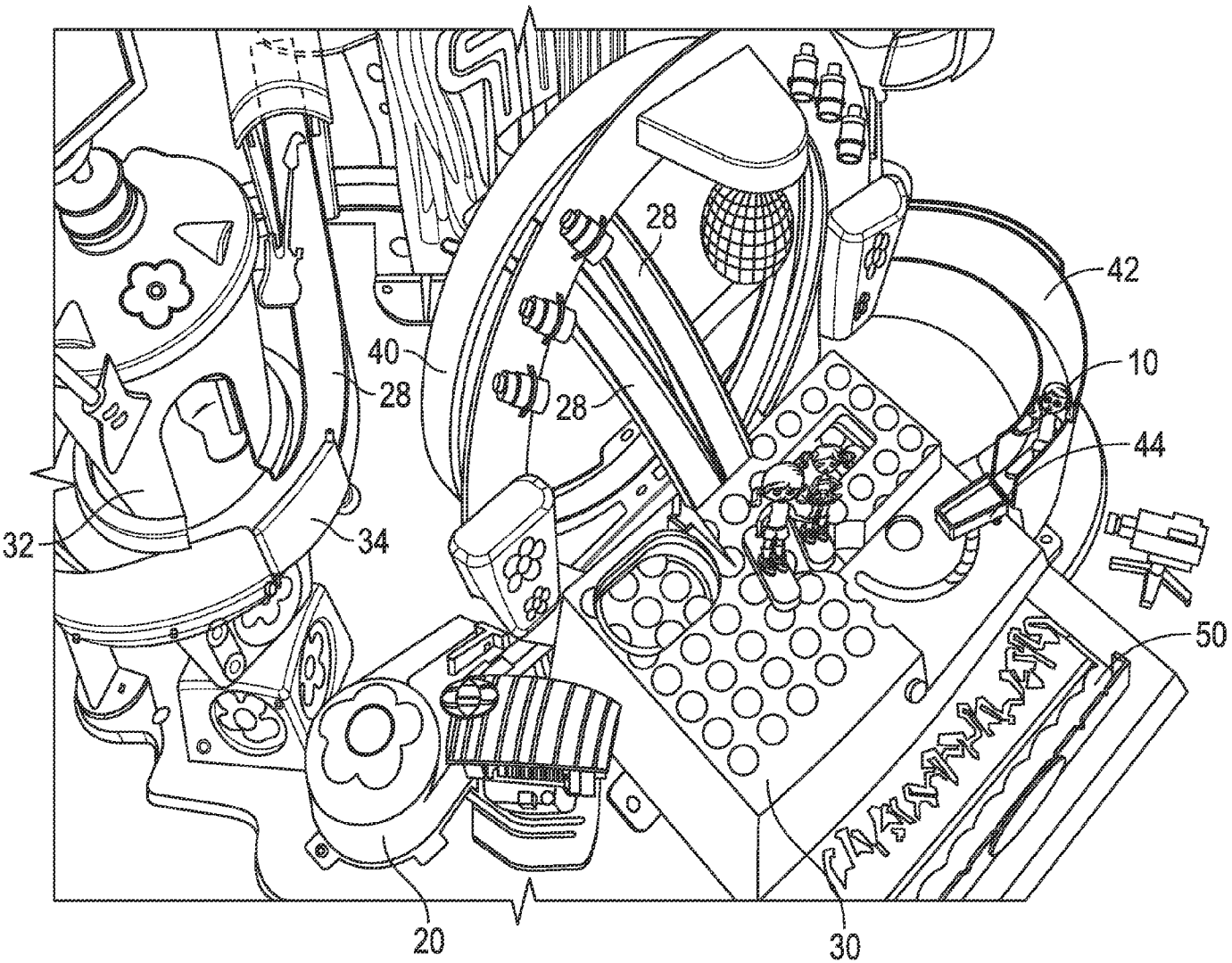
Figure 12C:
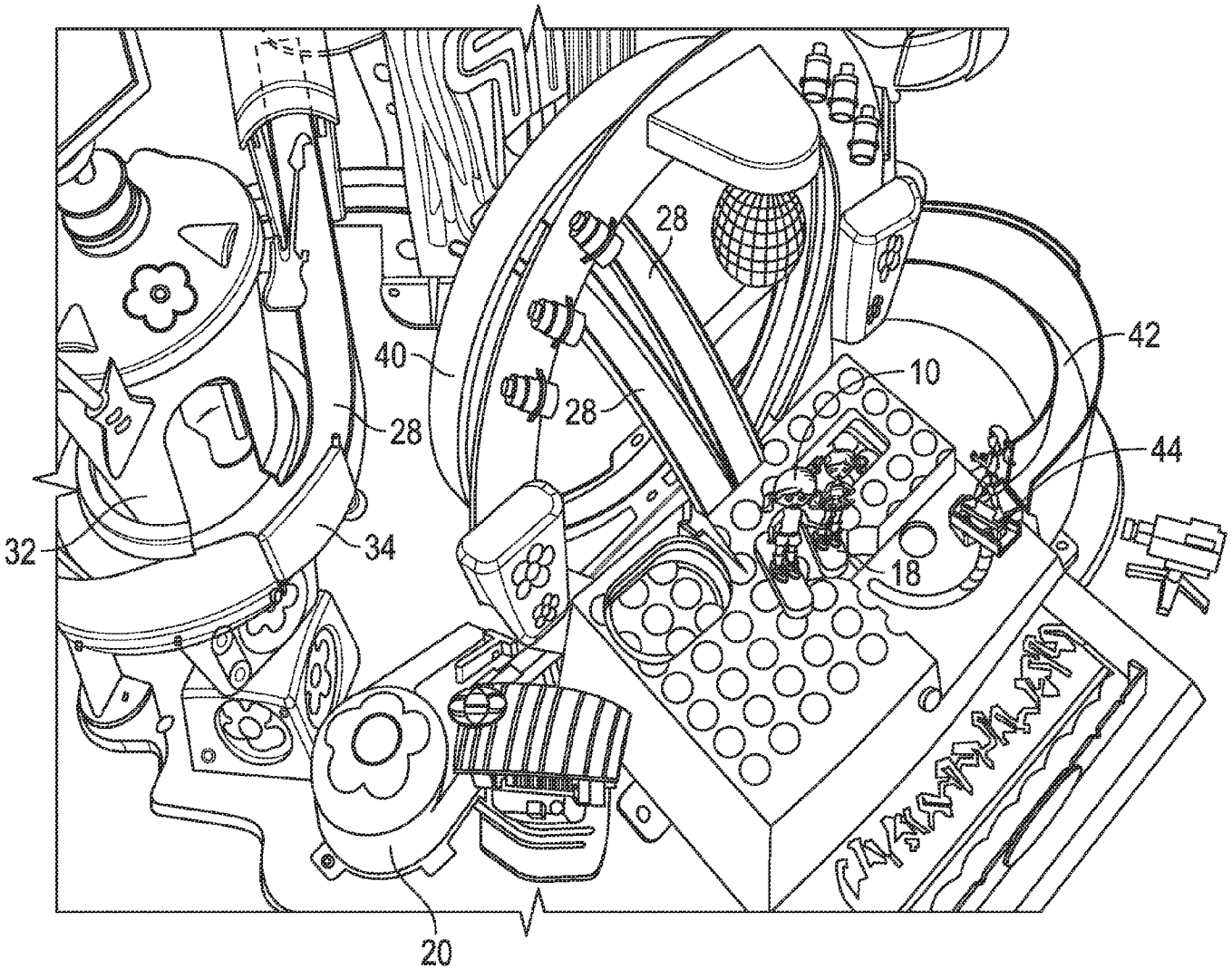
Figure 13:
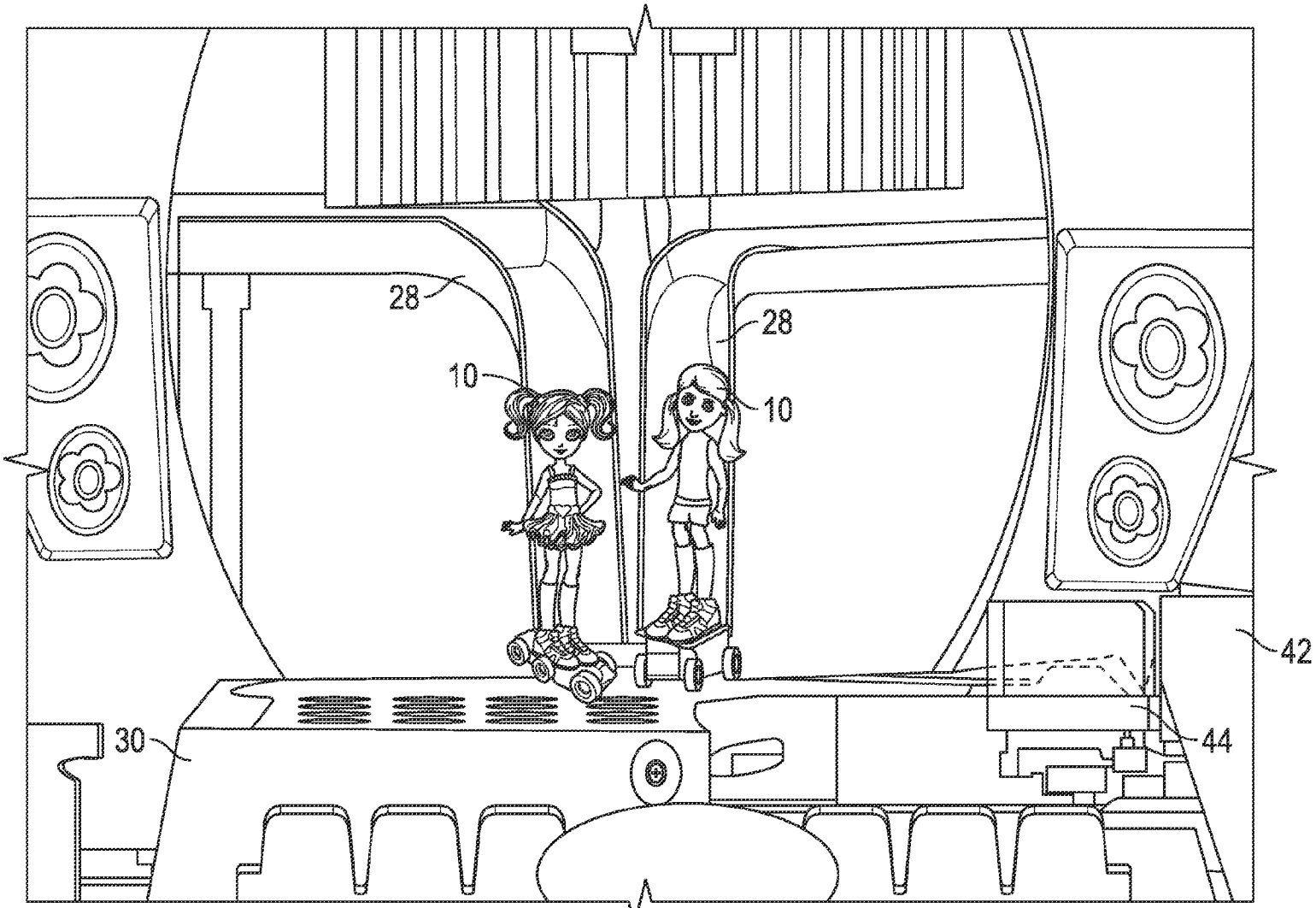
Figure 14A:
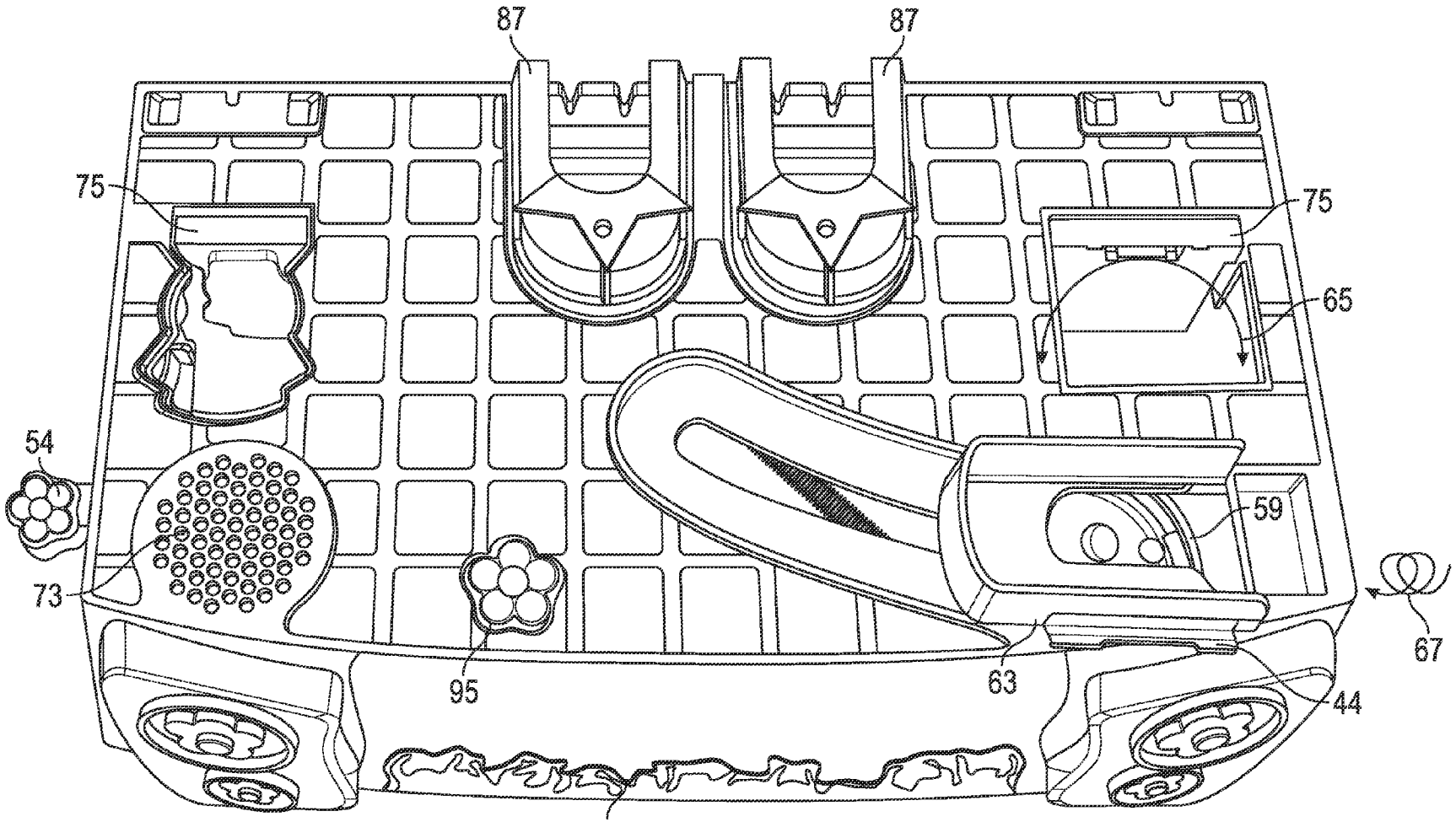
Figure 14B:
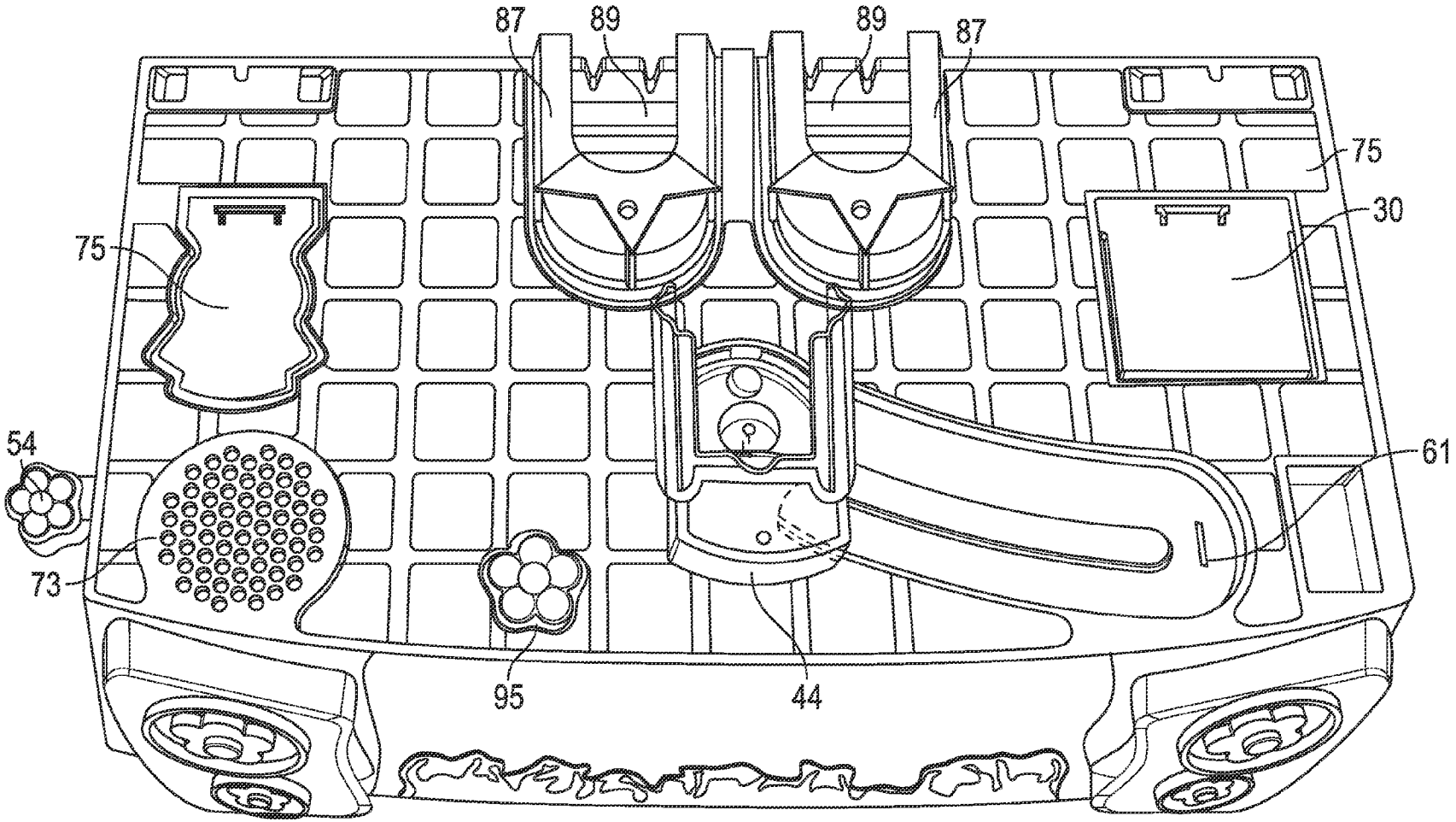
Figure 14C:
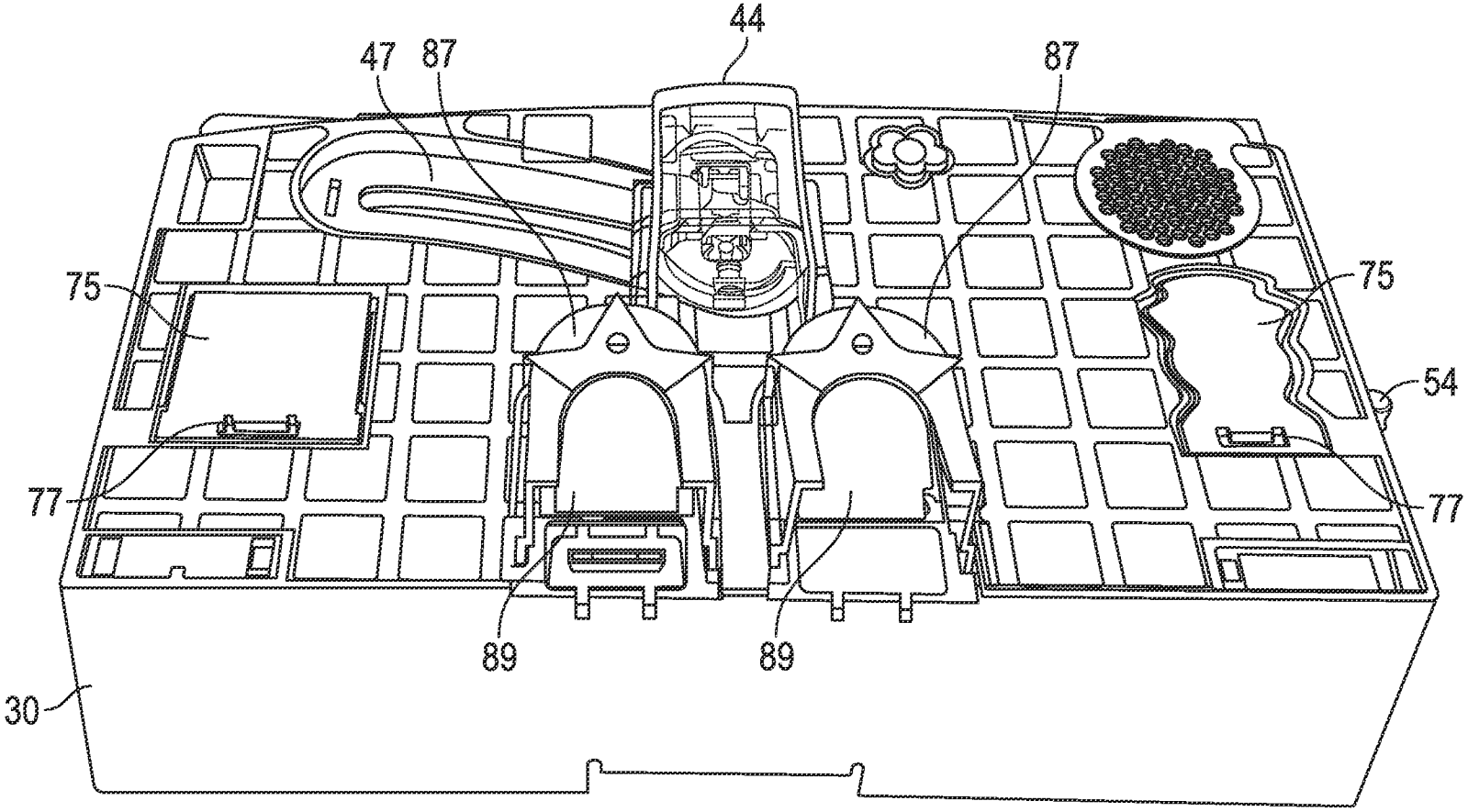
Figure 14D:
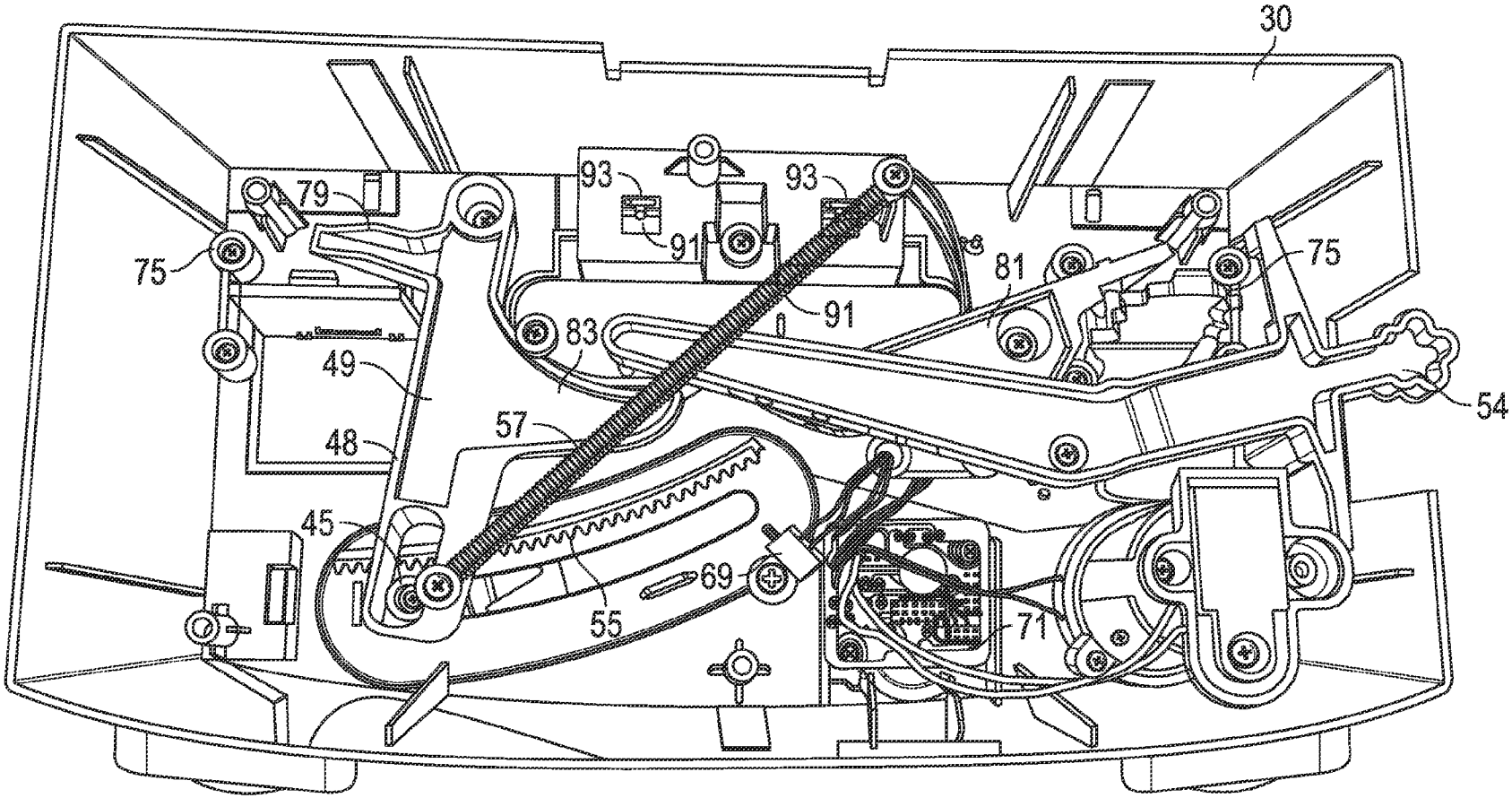
Figure 14E:
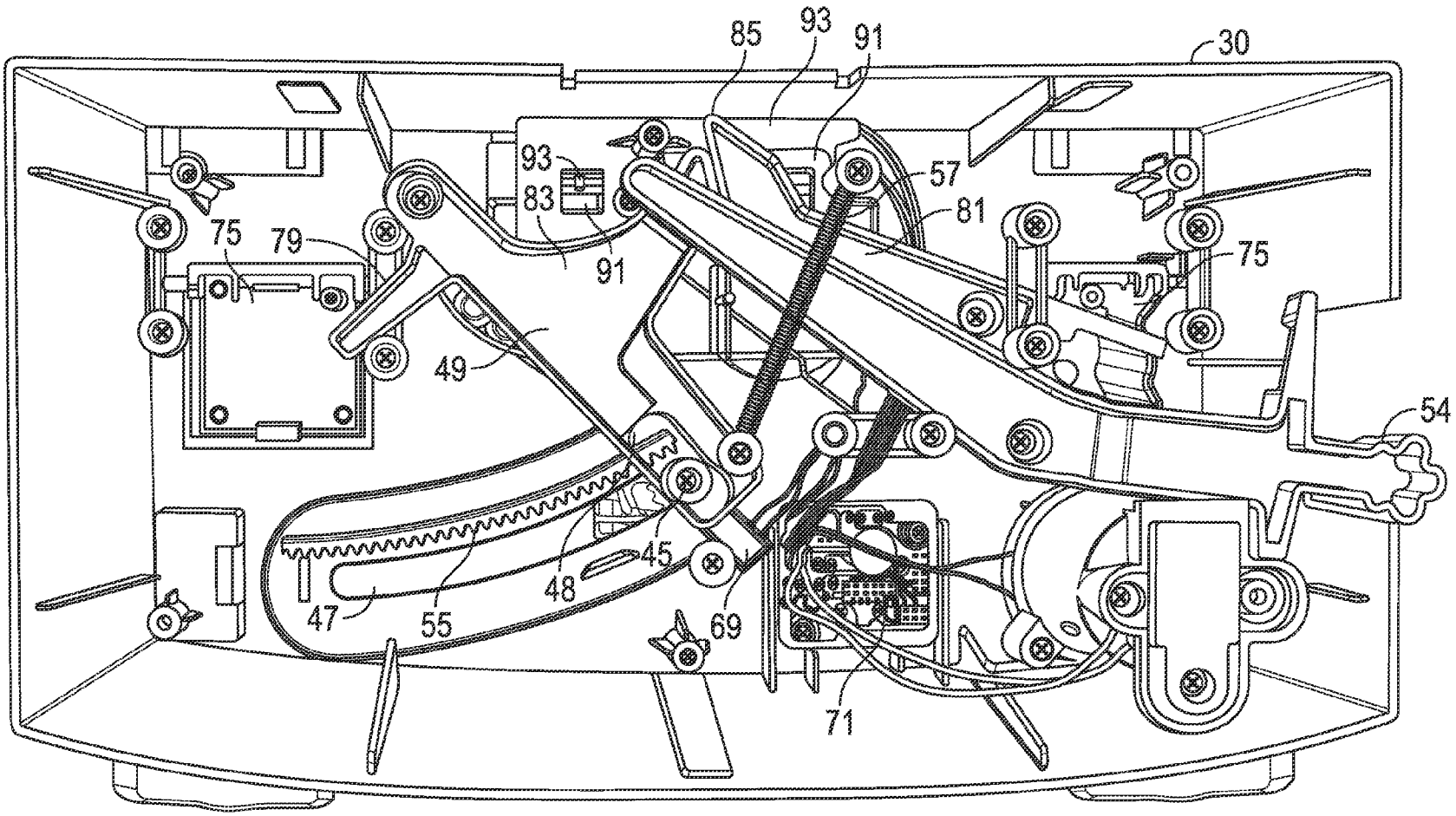

Referring now to FIGS. 14A-14E, one configuration of central area or stage 30 is illustrated. In this embodiment, the character or figurine 10 is received on one of a plurality of areas and receipt of the item will cause an audio output to be provided. In this configuration, the pop of scenery depicted as audience 50 is not included although inclusion of the same is considered to be within the scope of exemplary embodiments of the present invention. Alternatively, play set 16 can be configured such that no audio output is provided. As mentioned above, rotatably mounted carriage member 44 is positioned to receive character or FIG. 10 as it traverses along one of the numerous track paths of the play set. Carriage member 44 is configured for rotational movement from the first receiving position illustrated in at least FIG. 14A to a second ending position illustrated at least in FIG. 14C. Referring to FIGS. 14E and 14D, a bottom portion of carriage member 44 has a gear member 45 rotatably received within an opening 47 of the central area or stage 30 and an opening 48 of a first actuation lever 49. Gear member 45 is configured to engage a plurality of teeth 55 positioned along opening 47 such that as first actuating lever 49 transitions between a first position illustrated in FIG. 14D, which corresponds to the first receiving position of carriage member 44 and a second position illustrated in FIG. 14E, which corresponds to the second ending position of carriage member 44 gear member 45 will engage the plurality of teeth 55 thus causing rotational movement of the same.

In order to move the first actuating lever 49 into the first position manual reset arm 54 is manipulated to contact first actuating lever 49 and urge the first actuating lever 49 into the first position. As first actuating lever 49 is moved into the first position, a biasing member or spring 57 is expanded such that a biasing force urging the first actuating lever 49 into the second position is provided. First actuating lever 49 is retained in the first position by a feature 59, located on a bottom surface of carriage member 44, that is configured to engage a feature 61 located on central area 30 proximate to the first receiving position of carriage member 44. Accordingly, and as carriage member 44 is positioned into the first receiving position, feature 59 will engage feature 61 thus preventing the biasing force of spring 57 from rotating the carriage member 44 into the second ending position. In order to release feature 59 from feature 61 and thus allow carriage member 44 to rotate into the second ending position, carriage member 44 is pivotally mounted to gear member 45 via a pivot pin 63 such that carriage member 44 can rock or pivot back and forth in the directions of arrows 65 thus allowing feature 59 to become disengaged from feature 61 wherein carriage member 44 can rotate into the second ending position.

Accordingly, and when carriage member 44 is in the first receiving position an open end of the carriage member is configured to receive item 10 from one of the tracks of the play set. Once item 10 is received therein, carriage member 44 will pivot about pin 63 such that feature 59 is disengaged from feature 61 and carriage member 44 along with item 10 are rotated into the second ending position in the direction of arrow 67. In other words, carriage member 44 is pivoted when item 10 is received therein such that feature 59 is disengaged from feature 61 and carriage 44 with item 10 therein rotates into the second ending position.

In one embodiment wherein an audio enhancements are provided, and once carriage member 44 reaches the second ending position, a portion of the first actuating lever 49 contacts a switch 69 that is coupled to a microcontroller 71 and actuation of switch 69 causes microcontroller 71 to provide audio outputs to a speaker 73 in accordance with known technologies. Accordingly, and as carriage member 44 rotates to the second ending position, switch 69 will be actuated and audio outputs such as music is played.

In addition, and in order to provide additional enhancement features, a pair of platforms or doors 75 are pivotally secured to central area 30 for movement between a deployed position (see at least FIGS. 14B, 14C and 14E) and an undeployed position (see at least FIGS. 14A and 14D). Each of the doors 75 will have an opening 77 such that a character or scenery (e.g., instruments 52) can be received therein and the character or scenery only becomes viewable when the doors 75 are pivoted into the deployed position. In other words, the profile or height of the scenery 52 secured to opening 77 is shorter than the length of door 75 such that the scenery 52 is not viewable when the doors are in the undeployed position.

In order to transition the pair of doors 75 from the undeployed position to the deployed position, an arm member 79 of first actuating lever 49 is configured to urge one of the door members 75 from the undeployed position to the deployed position. In addition, a second actuating lever 81 is pivotally mounted to the base comprising central area 30 and is configured to contact door 75 and transition the same from the undeployed position to the deployed position as first actuating member 49 is transitioned from the first position to the second position. In order to facilitate this movement of the second actuating lever 81, an arm member 83 of the first actuating lever 49 is configured to contact a cam surface 85 of the second actuating lever 81.

In one embodiment, each of the pair of door members 75 are spring biased into the first or undeployed position such that as the first actuating lever 49 and the second actuating lever 81 are pivoted into the positions corresponding to the first receiving position of carriage 44 and accordingly door members 75 are pivoted into the undeployed position. Thereafter and as the biasing force of spring member 57 is released, the first actuating lever 49 and the second actuating lever 81 transition from a first position to a second position and thus cause door members 75 to transition from the undeployed position to the deployed position such that scenery secured thereto is now viewable from an upper surface of the central area.

Still further, and to provide additional audio features to the play set, a pair of stop members 87 are positioned to receive items 10 from tracks 28 of the play set. Each of the stop members 87 is configured to have a wall member that prevents further travel of items 10 as they reach the central area 30. In addition, each of the pair of stop members has a floor portion 89 pivotally secured thereto and biased into a first position by a spring or other equivalent biasing member such that as item 10 is received into one of the stop members 87, the biasing force of the spring is overcome and floor portion 89 is moved downwardly until a feature 91 of the floor portion contacts a switch 93.

Each switch 93 is coupled to microcontroller 71 and actuation of one of the switches 93 causes microcontroller 71 to provide audio outputs to speaker 73. Accordingly, and as an item is received in one of the stop members 87, floor portion 89 is depressed and feature 91 contacts switch 93 and audio outputs are provided to speaker 73. In addition and in order to provide additional audio outputs, a manual switch 95 is located on a surface of central area 30, wherein manual switch 95 is also secured to microcontroller 71 and actuation of the same will provide audio outputs to speaker 73. Accordingly and as illustrated in FIGS. 14A-14E, the central area 30 has multiple areas (e.g., carriage 44, stop members 87, etc.) into which a character or item 10 can be received and receipt of the character or item therein causes audio outputs to be provided.

Figure 15:
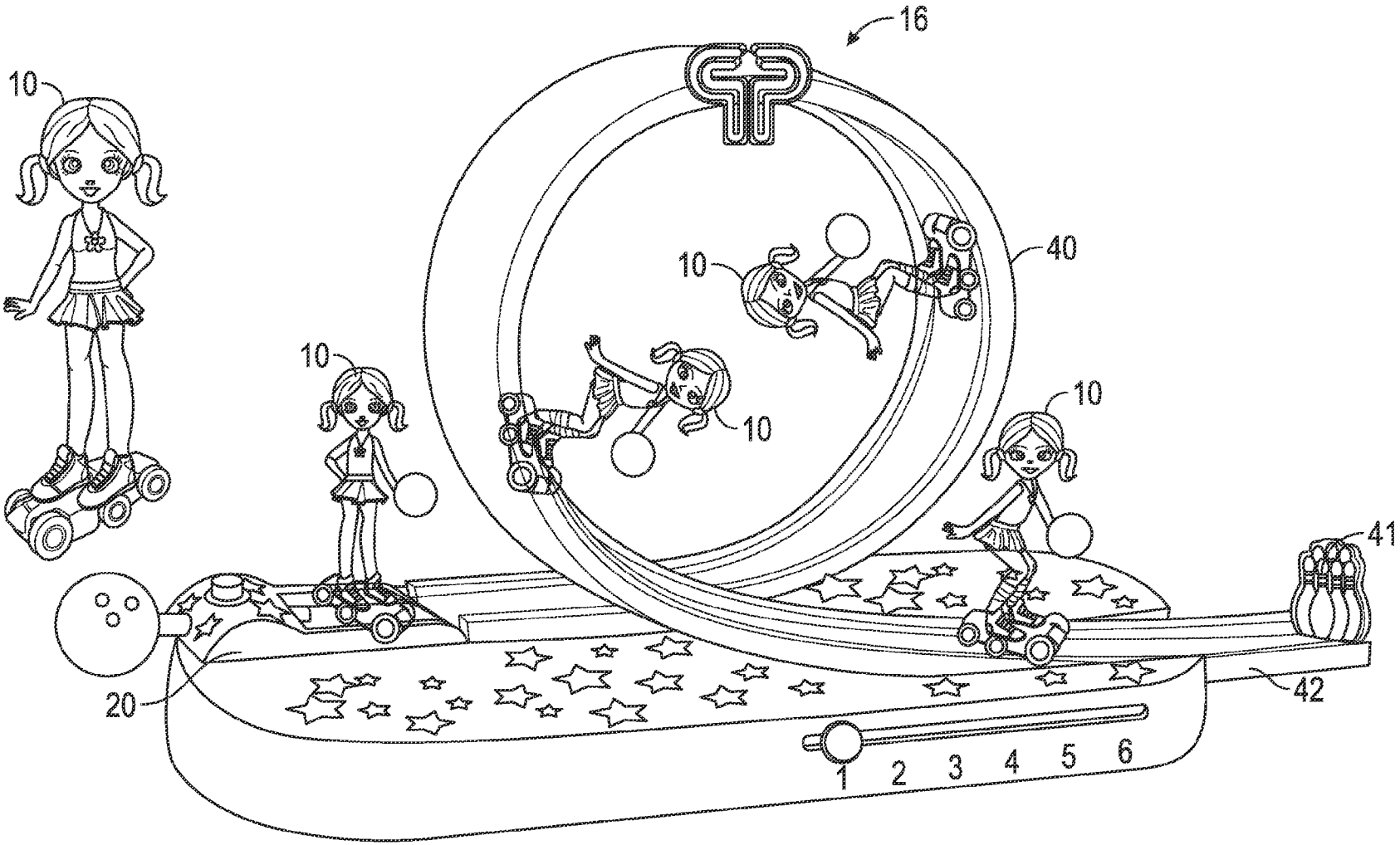
FIG. 15 is a perspective view of another play set in accordance with another alternative embodiment of the present invention.
Figure 15A:
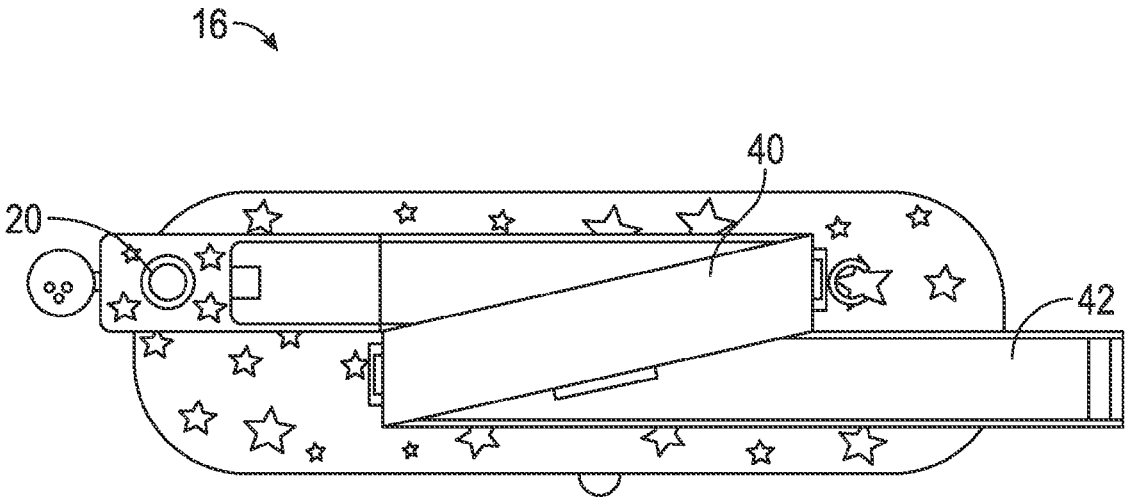
FIGS. 15A-15D are various views of the play set illustrated in FIG. 14.
Figure 15B:
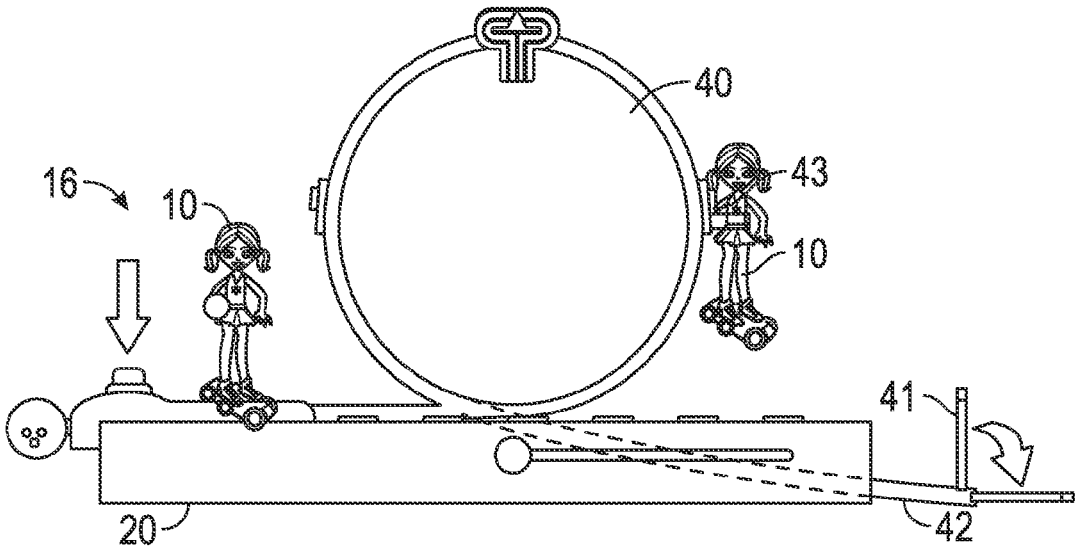
Figure 15C:
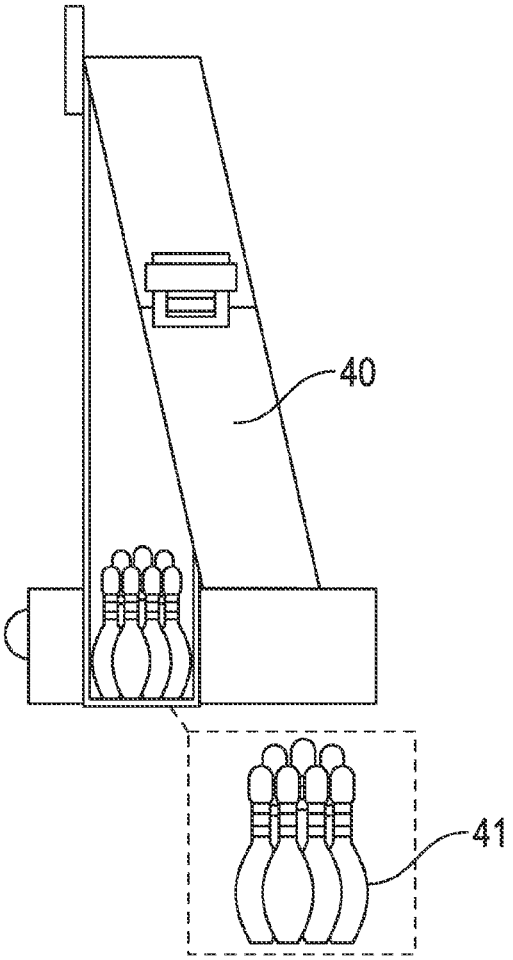
Figure 15D:
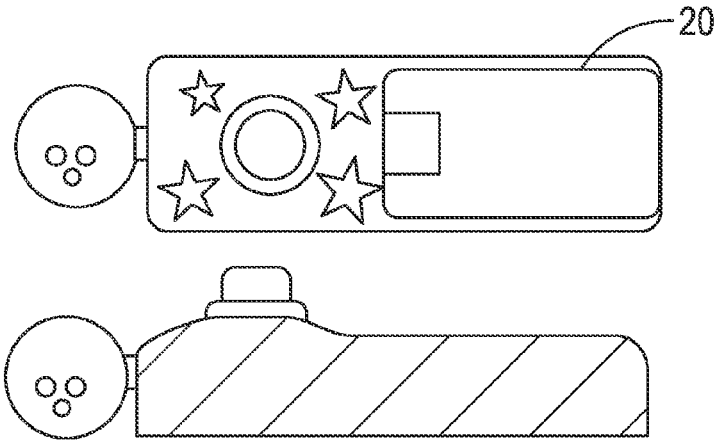

In an alternative embodiment and as illustrated in FIGS. 15-15D, the play set is configured to have a single loop. Here, the launcher 20 of the play set launches item 10 into a loop 40 that terminates with a target 41, which in this embodiment resembles a plurality of bowling pins. Of course, numerous other configurations or targets are contemplated. In one embodiment target 41 is a collapsible member pivotally secured to the end of any track segment 42 extending from loop 40. Alternatively, the target can comprise a plurality of bowling pins that are individually set up at a distal end of track segment 42. In one embodiment, a portion of the play set is configured to have a feature 43 that releasably engages item 10 for storage of item 10 with the play set such that the same will not be lost.

In this embodiment, the play set may also be configured such that it is foldable between a stowed position wherein the entire set collapses into a smaller profile wherein the loop portion of the track segment is flattened and a deployed position wherein the play set is expanded from the stowed position and the loop and other track sections expand accordingly.

Figure 16:
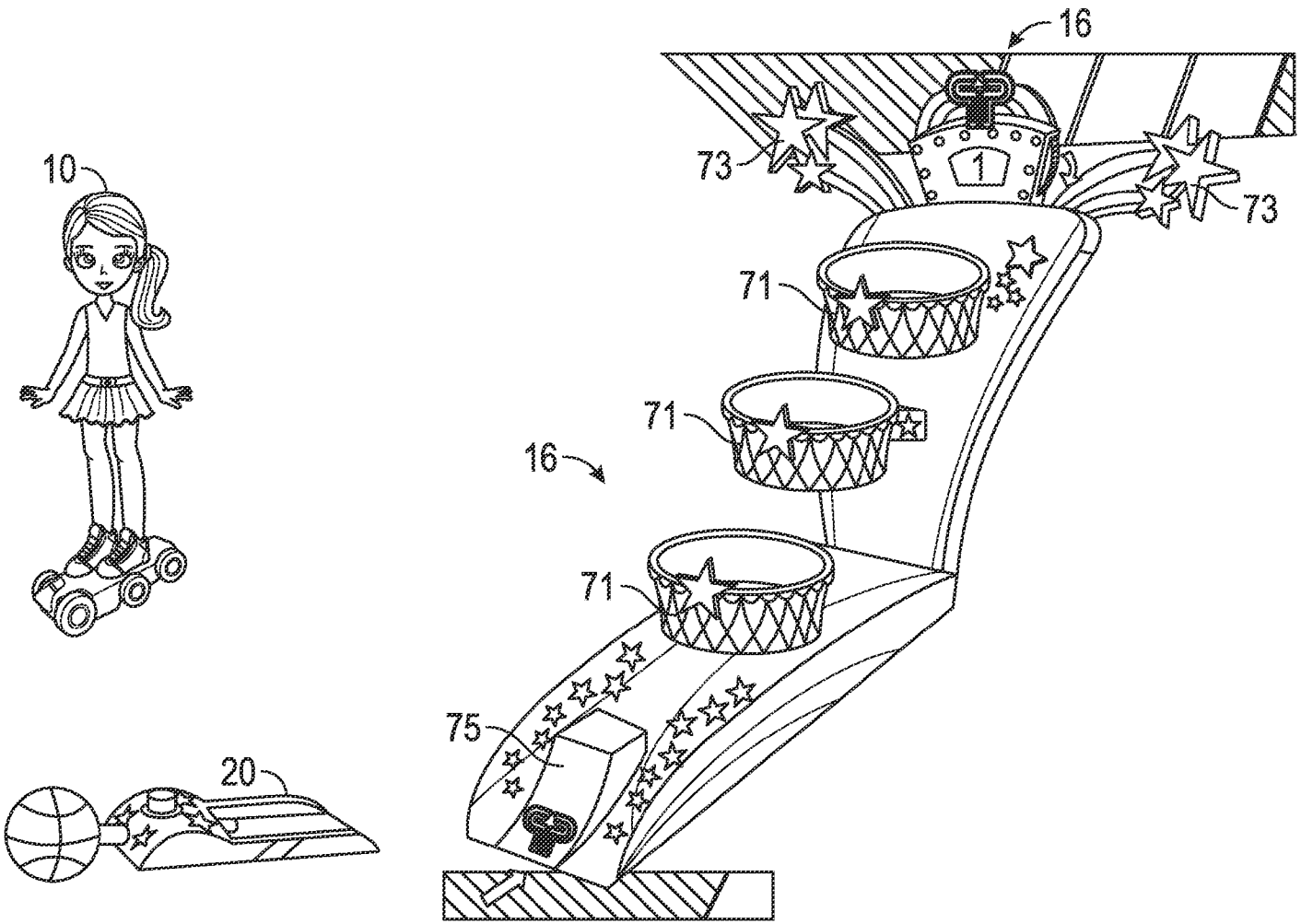
FIG. 16 is a perspective view of another play set in accordance with another alternative embodiment of the present invention.
Figure 16A:
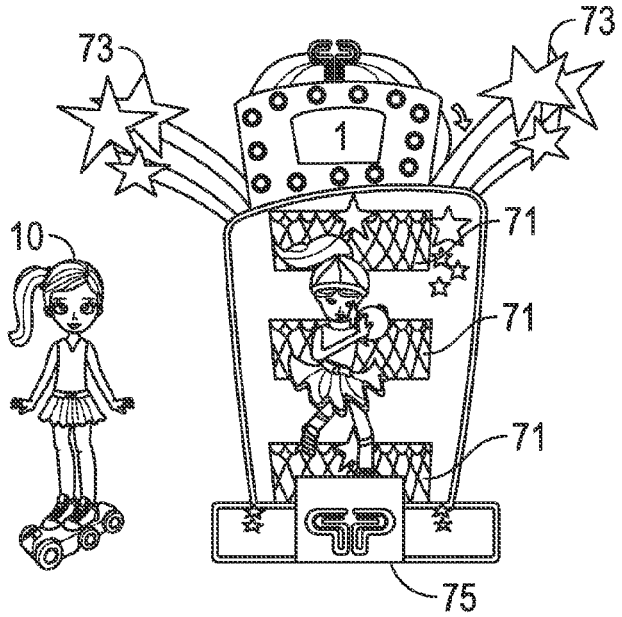
FIGS. 16A-16C are various views of the play set illustrated in FIG. 16.
Figure 16B:
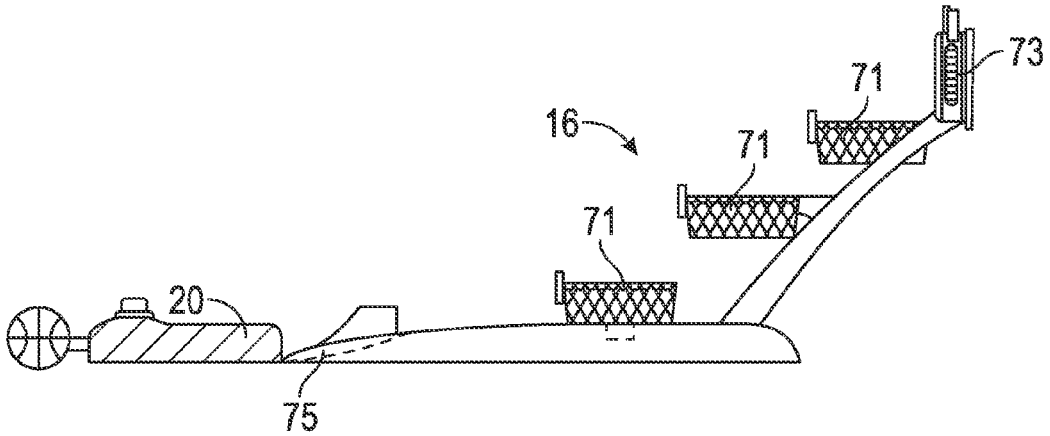
Figure 16C:
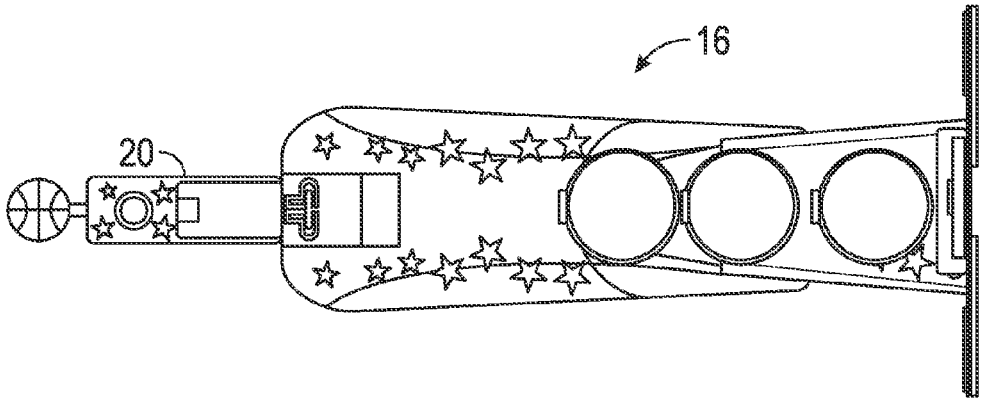
Figure 17A:
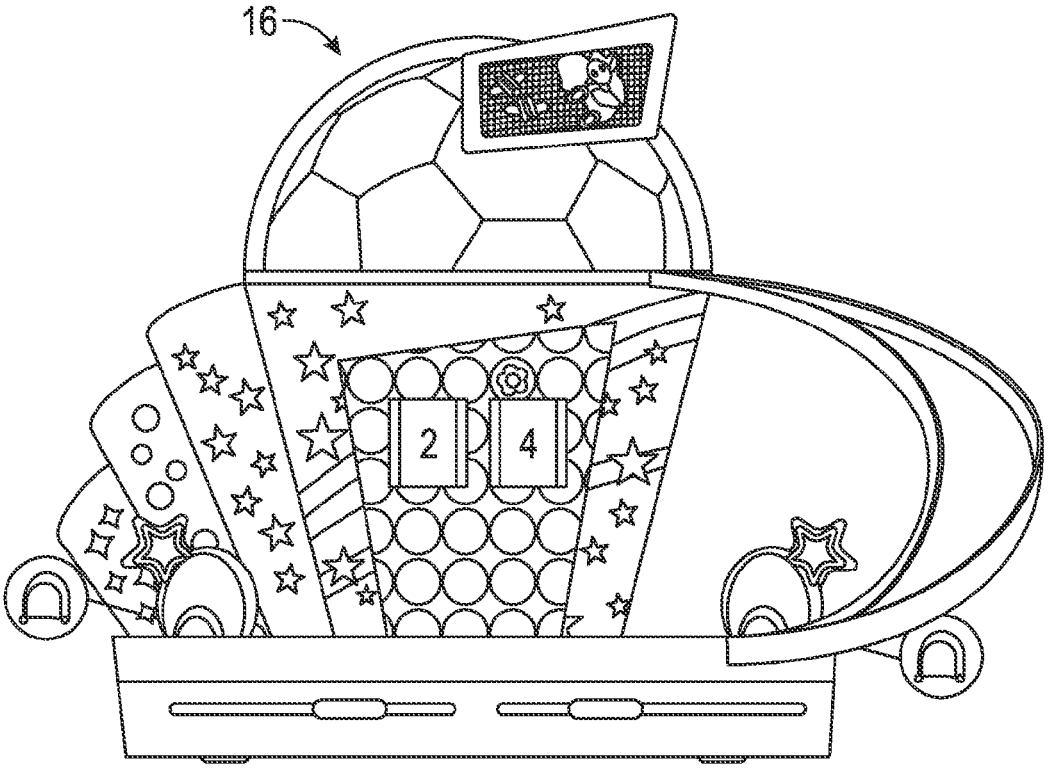
FIGS. 17A-17G illustrate a play set in accordance with still yet another alternative embodiment of the present invention.
Figure 17B:
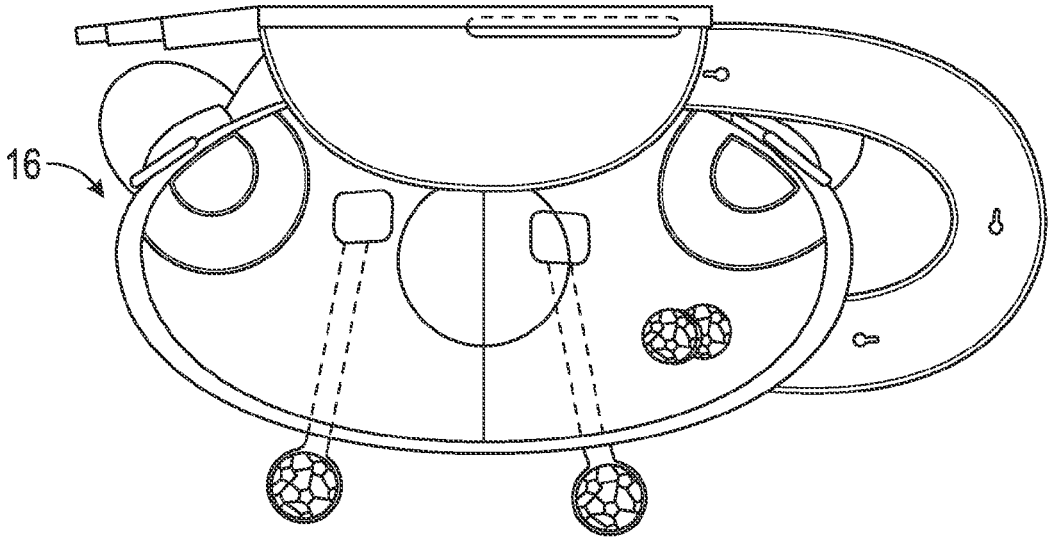
Figure 17C:
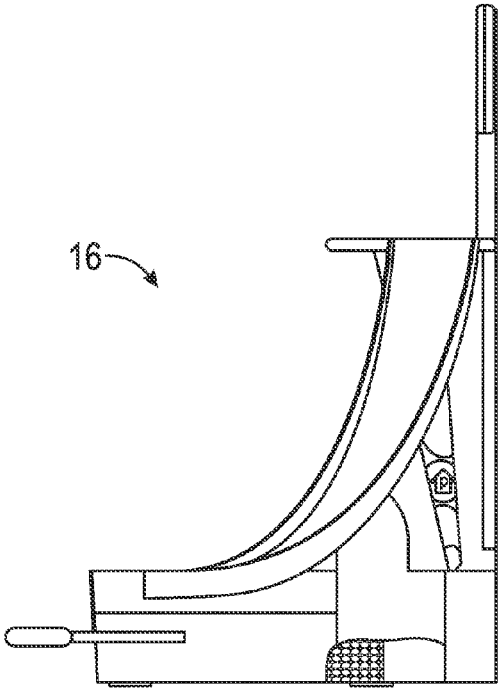
Figure 17D:
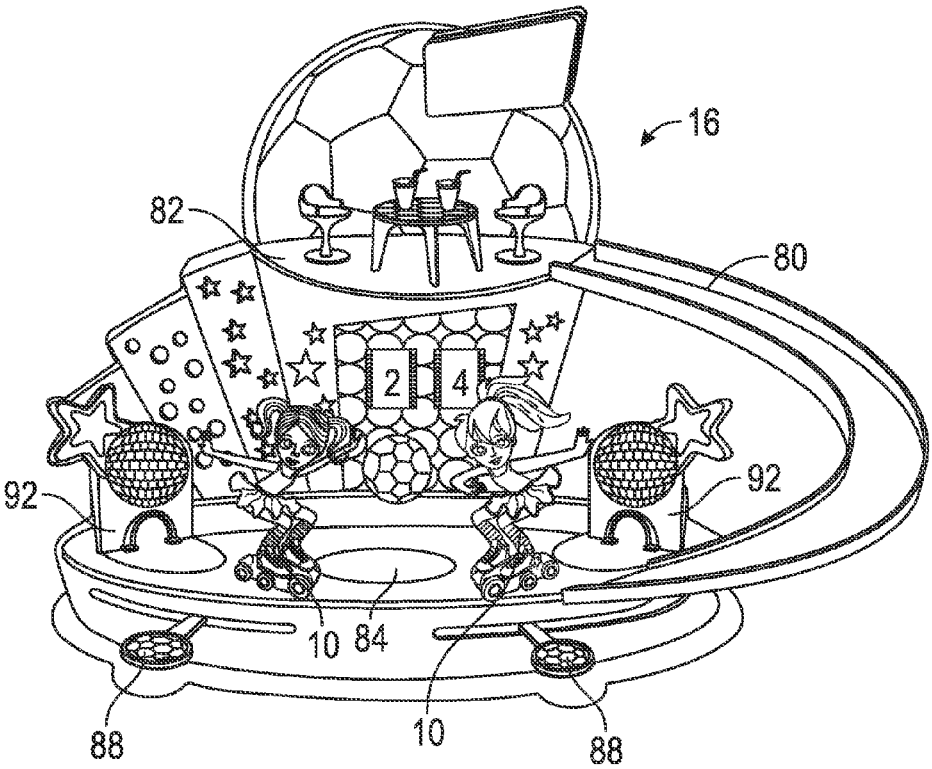
Figure 17E:
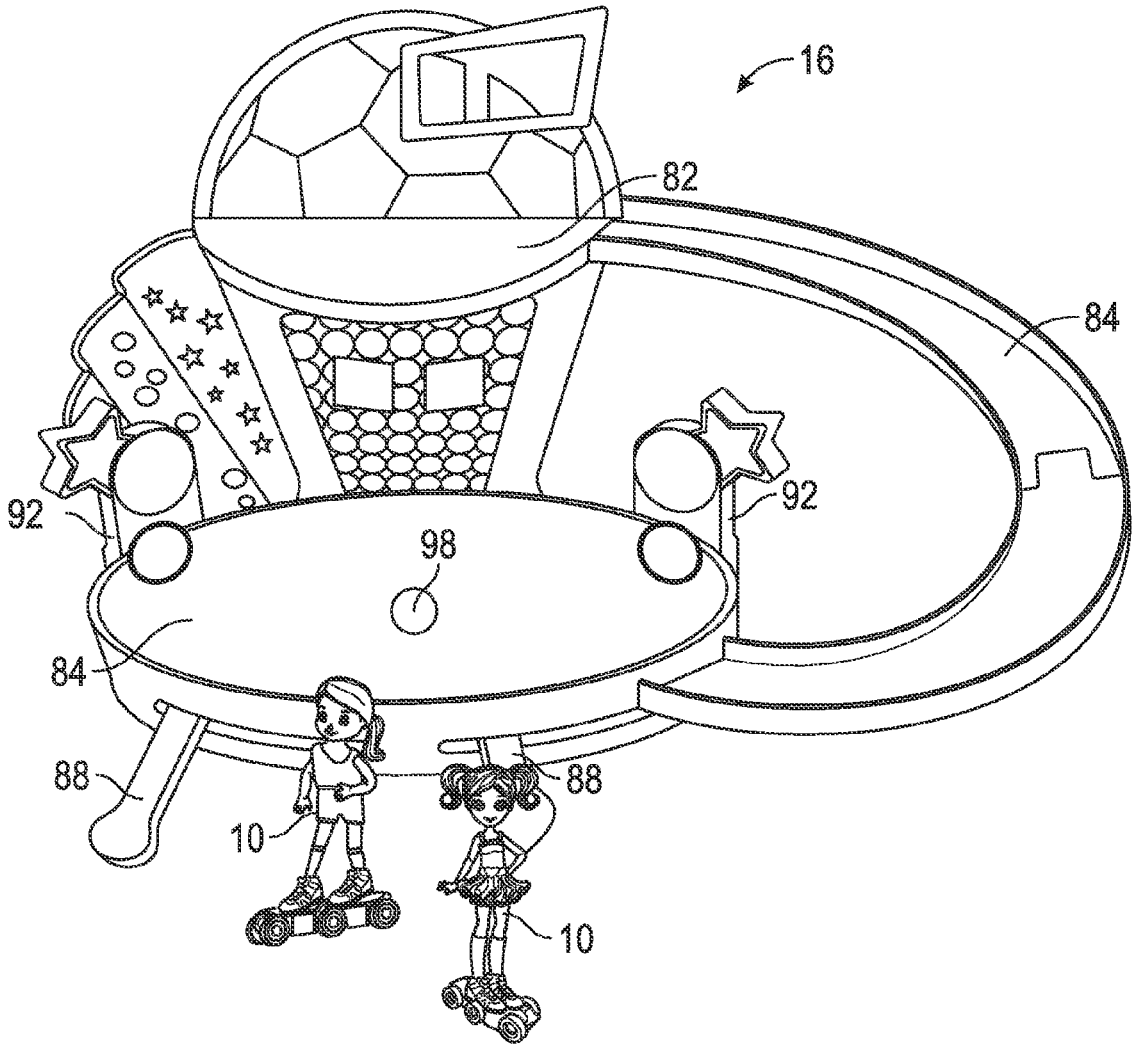
Figure 17F:
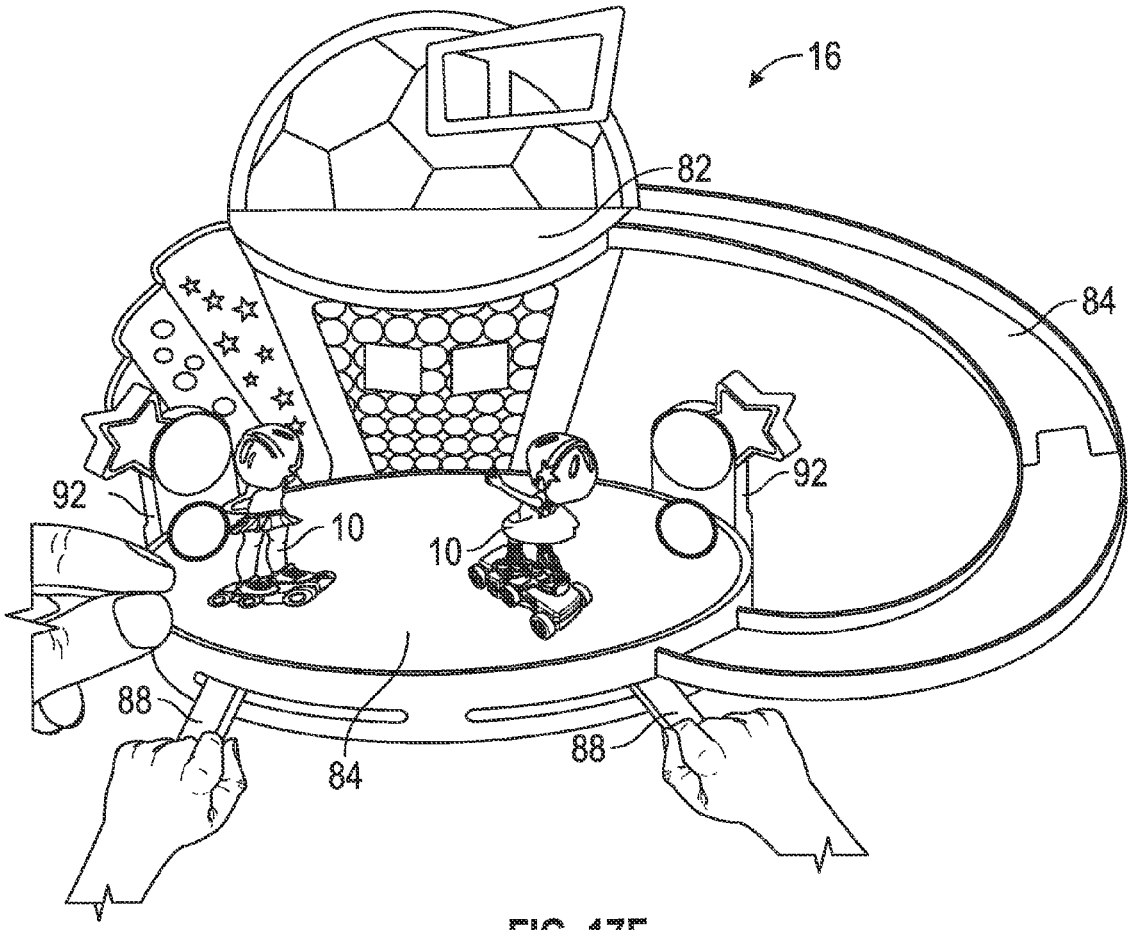
Figure 17G:
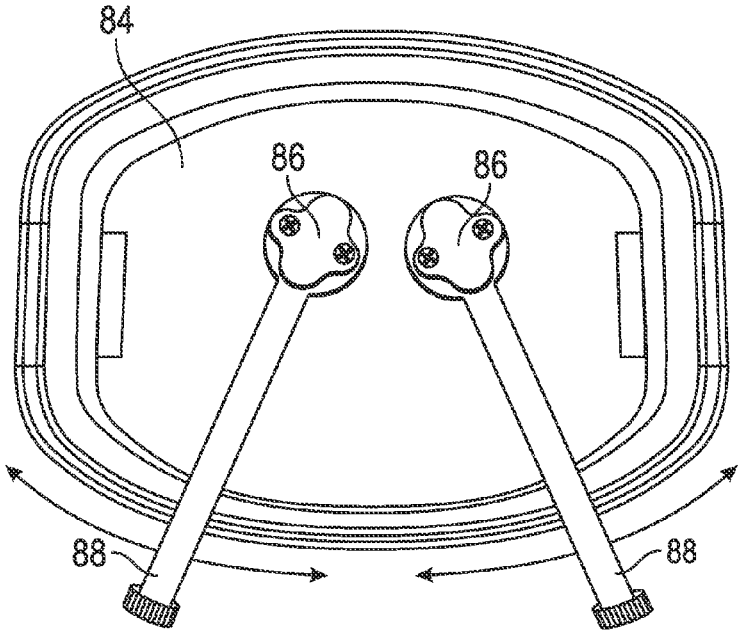

Referring now to FIGS. 16-16C another alternative configuration of play set 16 is illustrated. Here the character 10 that is mounted to the skateboard is launched into a series of elevated baskets 71 by a spring biased launcher 20, wherein each basket has a different point designation and in one embodiment a releasable member 73 that is actuated when the character is launched into a specific segment or basket of the play set. For example, the basket at the highest elevation or the basket that is not easily landed in will have a release mechanism disposed therein for actuation of a releasable member, which in one embodiment may comprise a pair of arms 73 pivotally secured to the play set. In order to cause a character to be launched towards the series of baskets a ramp member 75 is provided proximate to the spring biased launching mechanism 20.

Still further and in another configuration and as illustrated in FIGS. 17A-17G, another play set 16 is provided. In this play set, the figures travel down a track segment 80 from an elevated portion 82 to a ring area 84. Here magnets 86 are disposed on movable items 88 below the surface of the ring area and are configured to engage magnets or ferromagnetic materials in the skateboards or wheeled items 10 upon which the figure is secured. Accordingly and as the wand members are actuated by players each player can move a respective character engaged therewith due to the magnetic coupling between the wand and the item. In this embodiment, a game is provided wherein a ball 90 is manipulated by the characters as they are moved by the wand members and each player will attempt to score a goal by moving the ball into one of the pair of goals 92 disposed at a periphery of the ring.

Accordingly and at the start of each game, each figure can travel down from the elevated platform via the track segment and into the ring wherein the figure engages one of the magnetic members of the wands and the wands are then manipulated to cause the figures to move the ball across the surface of the ring and towards one of the goals.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A play set, comprising:

a base item having a plurality of wheels and an item removably secured to the base item, a plurality of track segments, wherein each of the plurality of track segments terminate at a central area, and a plurality of launchers each being configured to launch along one of the plurality of track segments; and a carriage rotatably secured to the central area for movement between a first position and a second position, wherein the carriage rotates about an axis as it translates from the first position to the second position along a path with respect to the central area, the axis being perpendicular to a direction the carriage travels as it translates between the first position and the second position, and wherein the carriage is configured to receive and retain the base item therein as the carriage rotates.

2. The play set as in claim 1, wherein the item is configured to resemble a character having a pair of feet that releasably engage a pair of shoes fixedly secured to the base item.

3. The play set as in claim 2, wherein the base item is configured to resemble a skateboard.

4. The play set as in claim 3, wherein the pair of shoes are formed from a rubber material molded into the skateboard.

5. The play set as in claim 4, wherein each of the pair of shoes have an opening at a rear portion of the shoes, wherein the opening is configured to allow a foot of the pair feet to be received therein.

6. The play set as in claim 2, wherein the pair of shoes are formed from a rubber material molded into the item.

7. The play set as in claim 1, wherein one of the plurality of launchers is coupled to a loop section that terminates at the carriage.

8. The play set as in claim 1, wherein at least one of the plurality of launchers is configured for reciprocal movement and the item disposed thereon will slide back and forth on a track section until the item gains enough momentum to travel over a raised portion of the track section and wherein the at least one of the plurality of launchers is elevated from the central area.

9. The play set as in claim 1, wherein at least one of the plurality of launchers has a track section pivotally secured thereto and movement of an actuator of the launcher causes a rear portion of the track section to move upward and the item disposed thereon will travel away from the launcher and wherein the at least one of the plurality of launchers is elevated from the central area.

10. The play set as in claim 1, wherein the plurality of launchers include a pair of launchers each having a track section pivotally secured thereto and movement of an actuator of the launcher causes a rear portion of the track section to move upward and the item disposed thereon will travel away from the launcher and wherein the pair of launchers is elevated from the central area.

11. The play set as in claim 10, wherein the item is configured to resemble a character having a pair of feet that releasably engage a pair of shoes fixedly secured to the base item.

12. The play set as in claim 11, wherein the base item is configured to resemble a skateboard having a plurality of wheels and wherein the pair of shoes are formed from a rubber material molded into the skateboard.

13. The play set as in claim 12, wherein each of the pair of shoes have an opening at a rear portion of the shoes, wherein the opening is configured to allow a foot of the pair feet to be received therein.

14. The play set as in claim 10, wherein another one of the plurality of launchers is coupled to a loop section that terminates at the carriage.

15. The play set as in claim 1, wherein the central area further comprises a microcontroller coupled to a speaker and a switch configured to be actuated when the carriage reaches the second position and the switch provides a signal to the microcontroller to provide audio outputs to the speaker.

16. The play set as in claim 1, wherein the central area further comprises a pair of stop members configured to receive items therein wherein each of the pair of stop members has floor portion pivotally secured thereto and each of the pair of stop members actuates a switch when an item is received within the stop member and the switch provides a signal to a microcontroller to provide audio outputs to a speaker.

* * * * *